US011448998B2

(12) United States Patent
Yasui

(10) Patent No.: US 11,448,998 B2
(45) Date of Patent: Sep. 20, 2022

(54) METAL FRAME OF IMAGE FORMING APPARATUS AND IMAGE FORMING APPARATUS

(71) Applicant: CANON KABUSHIKI KAISHA, Tokyo (JP)

(72) Inventor: Ryota Yasui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/398,809

(22) Filed: Aug. 10, 2021

(65) Prior Publication Data

US 2022/0082989 A1 Mar. 17, 2022

(30) Foreign Application Priority Data

Sep. 15, 2020 (JP) ..... JP2020-154950

(51) Int. Cl.

*G03G 21/16* (2006.01)
*G03G 15/00* (2006.01)
*G03G 21/18* (2006.01)

(52) U.S. Cl.

CPC ..... *G03G 21/1619* (2013.01); *G03G 15/00* (2013.01); *G03G 21/1633* (2013.01); *G03G 21/1647* (2013.01); *G03G 21/1842* (2013.01); *G03G 2221/1678* (2013.01)

(58) Field of Classification Search

CPC ..... G03G 15/00; G03G 21/1619; G03G 21/1633; G03G 21/1647; G03G 21/1842; G03G 2221/1678

See application file for complete search history.

(56) References Cited

U.S. PATENT DOCUMENTS

| | | | | |
|---|---|---|---|---|
| 9,442,458 | B2 | 9/2016 | Kobayashi et al. | G03G 21/1647 |
| 10,274,893 | B2 | 4/2019 | Yasui et al. | G03G 21/1619 |
| 10,691,061 | B2 | 6/2020 | Yasui | G03G 21/1647 |
| 10,775,733 | B2 | 9/2020 | Kobayashi et al. | G03G 15/0865 |
| 10,990,059 | B2 | 4/2021 | Kawasumi et al. | G03G 21/1619 |
| 11,099,517 | B2 | 8/2021 | Nakamura et al. | G03G 21/1619 |

(Continued)

FOREIGN PATENT DOCUMENTS

JP 2008-116619 5/2008

OTHER PUBLICATIONS

U.S. Appl. No. 17/398,568, filed Aug. 10, 2021.
U.S. Appl. No. 17/398,743, filed Aug. 10, 2021.

*Primary Examiner* — Joseph S Wong
(74) *Attorney, Agent, or Firm* — Venable LLP

(57) ABSTRACT

A metal frame of an image forming apparatus including
a first support which includes a first metal plate;
a second support; and
a third support which includes a second metal plate,
wherein either the first metal plate or the second metal plate includes a through-hole formed in a surface portion,
the other of the first metal plate and the second metal plate includes
an insertion portion,
a first facing portion configured to face a first surface of the surface portion, and
a second facing portion configured to face a second surface of the surface portion, and
wherein in the plate thickness direction of the surface portion, a distance between a tip portion of the insertion portion of the one metal plate and the second facing (Continued)

portion is smaller than a plate thickness of the surface portion of the other metal plate.

11 Claims, 30 Drawing Sheets

(56) References Cited

U.S. PATENT DOCUMENTS

| | | | | |
|---|---|---|---|---|
| 2009/0274484 | A1* | 11/2009 | Takemoto | G03G 21/16 399/107 |
| 2015/0063864 | A1* | 3/2015 | Kitan | G03G 21/1619 399/107 |
| 2015/0143676 | A1* | 5/2015 | Kanayama | H04N 1/00557 24/698.2 |
| 2020/0094302 | A1 | 3/2020 | Yahagi et al. | B21D 5/01 |
| 2021/0063943 | A1 | 3/2021 | Tomono et al. | G03G 21/1619 |
| 2021/0063946 | A1 | 3/2021 | Watanabe et al. | G03G 21/1619 |

* cited by examiner

METAL FRAME OF IMAGE FORMING APPARATUS AND IMAGE FORMING APPARATUS

BACKGROUND OF THE INVENTION

Field of the Invention

The present invention relates to a metal frame of an image forming apparatus such as an electrophotographic copying machine and an electrophotographic printer (for example, a laser beam printer or a light emitting diode (LED) printer).

Description of the Related Art

A frame of an image forming apparatus is generally formed by fixing a plurality of metal plates such as a front side plate, a rear side plate, and a stay connecting between the front side plate and the rear side plate to each other by welding or the like. By fixing such metal plates to each other in a state where they are assembled to each other with high position accuracy, position accuracy between respective members supported by the frame is maintained, such that it becomes possible to form a high-quality image.

Meanwhile, Japanese Patent Application Laid-Open No. 2008-116619 describes a configuration for assembling a first metal plate and a second metal plate, which are metal plates constituting a frame of an image forming apparatus, to each other with high position accuracy. The configuration described in Japanese Patent Application Laid-Open No. 2008-116619 is a configuration in which a protrusion portion formed on the first metal plate is inserted into an opening portion formed in the second metal plate to assemble the first metal plate and the second metal plate to each other. A first bulging portion that abuts on one surface of the protrusion portion of the first metal plate in a plate thickness direction and a second bulging portion that abuts on the other surface of the first metal plate in the plate thickness direction are formed inside the opening portion of the second metal plate. By nipping the protrusion portion from the plate thickness direction by the first bulging portion and the second bulging portion, a position of the first metal plate with respect to the second metal plate in the plate thickness direction is determined. In addition, in a direction orthogonal to an insertion direction of the first metal plate into the second metal plate and the plate thickness direction of the first metal plate, by making a width of the opening portion and a width of the protrusion portion substantially the same as each other, a position of the first metal plate with respect to the second metal plate in the orthogonal direction is determined.

However, in the configuration described in Japanese Patent Application Laid-Open No. 2008-116619, a portion that restricts movement of the first metal plate with respect to the second metal plate in a direction opposite to the insertion direction is not provided. Therefore, in a case where an unintended force is applied to the first metal plate or the second metal plate in a state where the first metal plate is assembled to the second metal plate, there is a possibility that the first metal plate will move with respect to the second metal plate in the direction opposite to the insertion direction, such that the first metal plate and the second metal plate are separated from each other, resulting in deterioration of position accuracy.

SUMMARY OF THE INVENTION

It is desirable to provide a metal frame of an image forming apparatus capable of suppressing metal plates constituting the metal frame from being separated from each other and deteriorating position accuracy.

A representative configuration of the present invention provides a metal frame of an image forming apparatus, including:

a first support configured to support one end of an image forming unit that forms an image on a sheet, the first support including a first metal plate;

a second support which is spaced apart from the first support and configured to support the other end of the image forming unit; and a third support configured to connect the first support and the second support, the third support including a second metal plate that engages with the first metal plate from above in a vertical direction, wherein either the first metal plate or the second metal plate includes a through-hole formed in a surface portion extending in the vertical direction, the other of the first metal plate and the second metal plate includes an insertion portion to be inserted into the through-hole, a first facing portion configured to face a first surface, which is one surface of the surface portion in a plate thickness direction of the surface portion, and is at a position above the insertion portion in the vertical direction and is continuously provided from the insertion portion, and a second facing portion configured to face a second surface, which is a surface opposite to the first surface in the plate thickness direction of the surface portion, and wherein in the plate thickness direction of the surface portion, a distance between a tip portion of the insertion portion of the one metal plate and the second facing portion is smaller than a plate thickness of the surface portion of the other metal plate.

Further features of the present invention will become apparent from the following description of exemplary embodiments with reference to the attached drawings.

DESCRIPTION OF THE EMBODIMENTS

<Image Forming Apparatus>

Hereinafter, an overall configuration of an image forming apparatus according to the present invention will be described with reference to the drawings, together with an operation at the time of image formation. Note that dimensions, materials, shapes, relative arrangements, and the like of components described below are not intended to limit the scope of the present invention unless specifically stated otherwise.

An image forming apparatus A according to the present embodiment is an intermediate tandem type electrophotographic image forming apparatus that transfers toners of four colors of yellow Y, magenta M, cyan C, and black K to an intermediate transfer belt, and then transfers an image to a sheet to form the image. Note that in the following description, Y, M, C, and K are added as subscripts to members using the toners of the respective colors, but since configurations or operations of the respective members are substantially the same as each other except that colors of the toners used in the respective members are different from each other, the subscripts are appropriately omitted unless it is necessary to distinguish the configurations or the operations of the respective members from each other.

Figure 1:
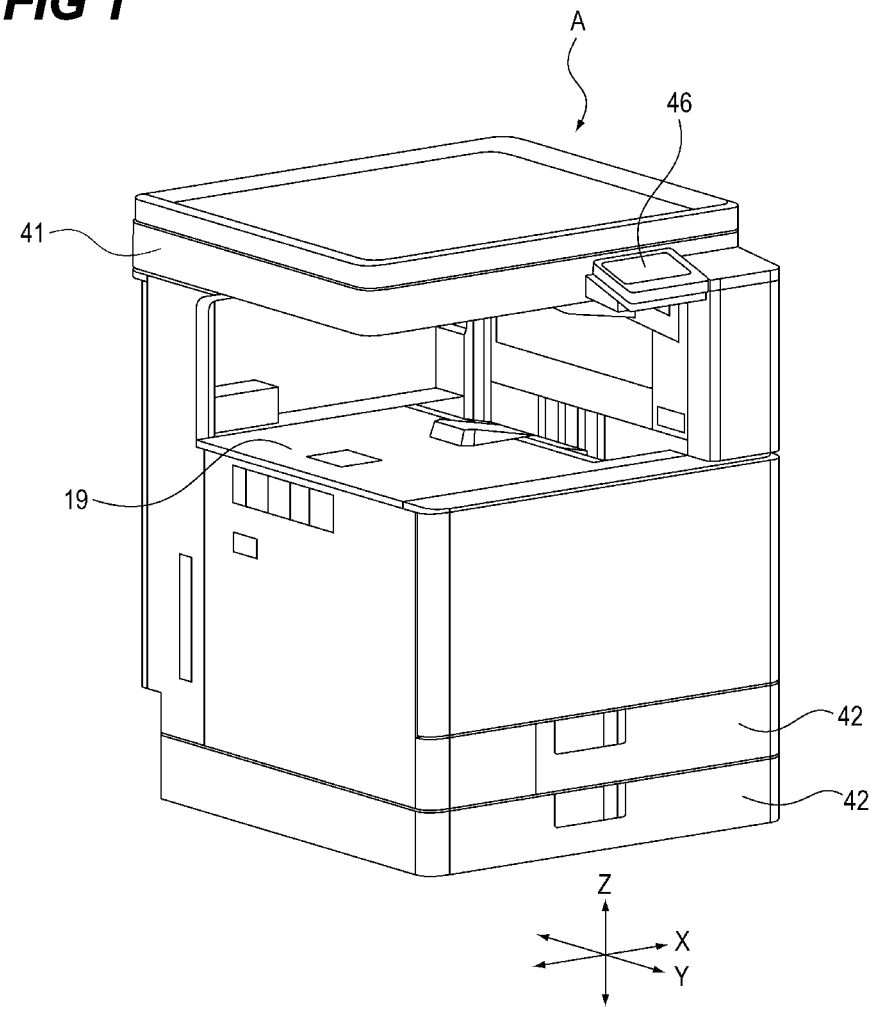
FIG. 1 is a schematic perspective view of an image forming apparatus.
Figure 2:
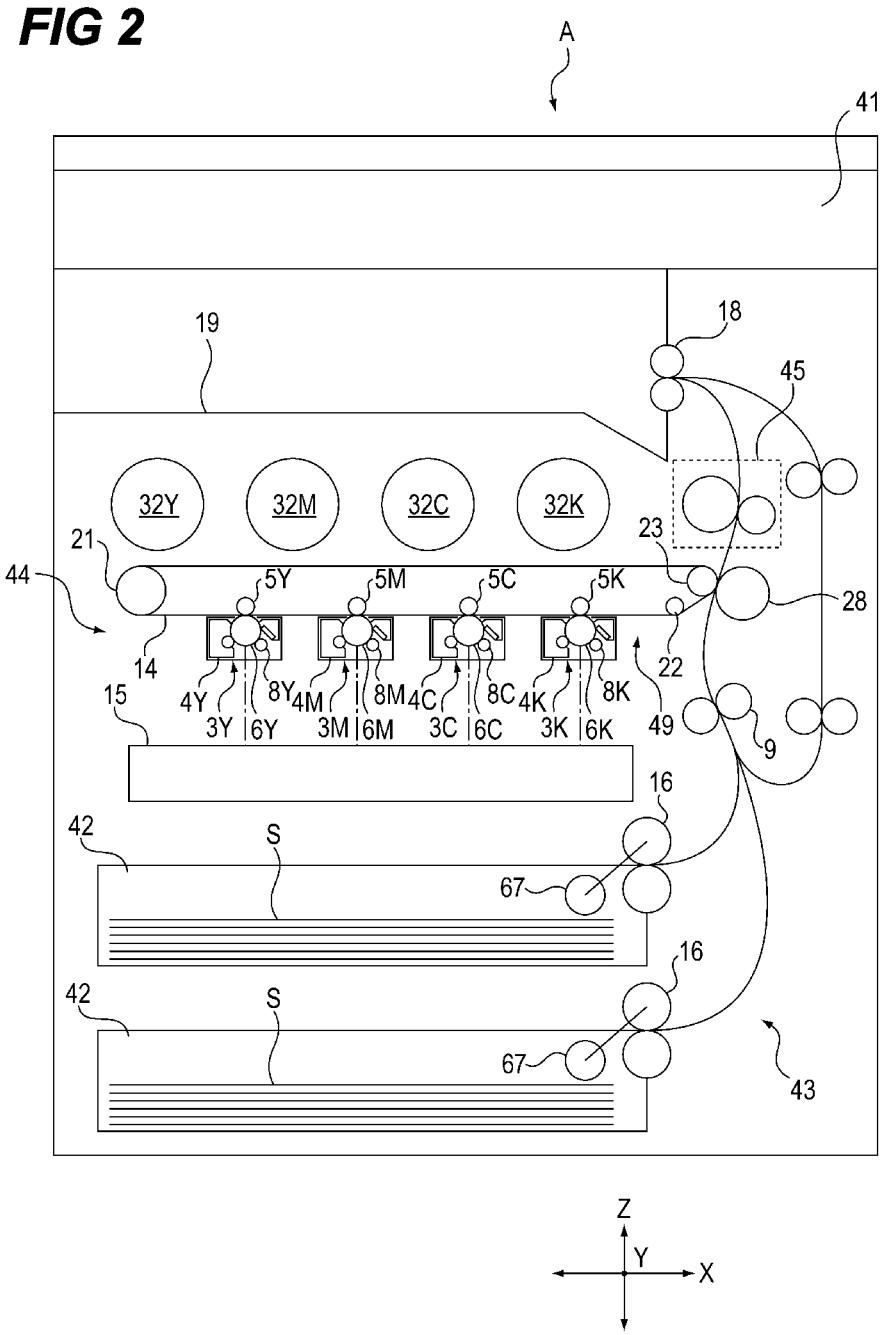
FIG. 2 is a schematic cross-sectional view of the image forming apparatus.

FIG. 1 is a schematic perspective view of an image forming apparatus A. FIG. 2 is a schematic cross-sectional view of an image forming apparatus A. As illustrated in FIGS. 1 and 2, the image forming apparatus A includes an image forming portion 44 that forms a toner image and transfers the toner image to a sheet, a sheet feeding portion 43 that feeds the sheet toward the image forming portion 44, and a fixing portion 45 that fixes the toner image to the sheet. In addition, an image reading portion 41 that reads an image of an original is provided at an upper portion of the image forming apparatus A.

The image forming portion 44 includes a process cartridge 3: 3Y, 3M, 3C, and 3K, a laser scanner unit 15, and an intermediate transfer unit 49. The process cartridge 3, which is an example of the image forming unit, is configured to be detachably attached to the image forming apparatus A, and includes a photosensitive drum 6: 6Y, 6M, 6C, and 6K, a charging roller 8: 8Y, 8M, 8C, and 8K, and a developing device 4: 4Y, 4M, 4C, and 4K.

The intermediate transfer unit 49 includes a primary transfer roller 5: 5Y, 5M, 5C, and 5K, an intermediate transfer belt 14, a secondary transfer roller 28, a secondary transfer counter roller 23, a driving roller 21, and a tension roller 22. The intermediate transfer belt 14 is stretched over the secondary transfer counter roller 23, the driving roller 21, and the tension roller 22, the driving roller 21 rotates by a driving force of a motor (not illustrated), and the intermediate transfer belt 14 circularly moves according to the rotation of the tension roller 22.

Next, an image forming operation by the image forming apparatus A will be described. First, when an image forming job signal is input to a controller (not illustrated), a sheet S stacked and stored in a sheet cassette 42 is sent out to a registration roller 9 by a feeding roller 16. Next, the sheet S is sent into a secondary transfer portion including the secondary transfer roller 28 and the secondary transfer counter roller 23 at a predetermined timing by the registration roller 9.

Meanwhile, in the image forming portion, first, a surface of the photosensitive drum 6Y is charged by the charging roller 8Y. Then, the laser scanner unit 15 irradiates the surface of the photosensitive drum 6Y with laser light according to an image signal transmitted from an external device (not illustrated) or the like to form an electrostatic latent image on the surface of the photosensitive drum 6Y.

Then, a yellow toner is attached to the electrostatic latent image formed on the surface of the photosensitive drum 6Y by the developing device 4Y to form a yellow toner image on the surface of the photosensitive drum 6Y. The toner image formed on the surface of the photosensitive drum 6Y is primarily transferred to the intermediate transfer belt 14 by applying a bias to the primary transfer roller 5Y.

Magenta, cyan, and black toner images are also formed on the photosensitive drums 6M, 6C, and 6K by a similar process. These toner images are transferred in a superimposed manner onto the yellow toner image on the intermediate transfer belt 14 by applying a primary transfer bias to the primary transfer rollers 5M, 5C, and 5K. As a result, a full-color toner image is formed on a surface of the intermediate transfer belt 14.

Note that when the toner inside the developing device 4 is used by the developing process described above, such that an amount of toner inside the developing device 4 decreases, each developing device 4 is replenished with a toner of each color by a toner bottle 32: 32Y, 32M, 32C, and 32K. The toner bottle 32 is configured to be detachably attachable to the image forming apparatus A.

Then, the intermediate transfer belt 14 circularly moves, such that a full-color toner image is sent to the secondary transfer portion. The full-color toner image on the intermediate transfer belt 14 is transferred to the sheet S by applying a bias to the secondary transfer roller 28 in the secondary transfer portion.

Then, the sheet S to which the toner image is transferred is subjected to heating and pressuring processing in the fixing portion 45, such that the toner image on the sheet S is fixed to the sheet S. Then, the sheet S to which the toner image is fixed is discharged to a discharge portion 19 by a discharge roller 18.

<Frame of Image Forming Apparatus>

Next, a frame 31 (metal frame) of the image forming apparatus A will be described.

Figure 3:
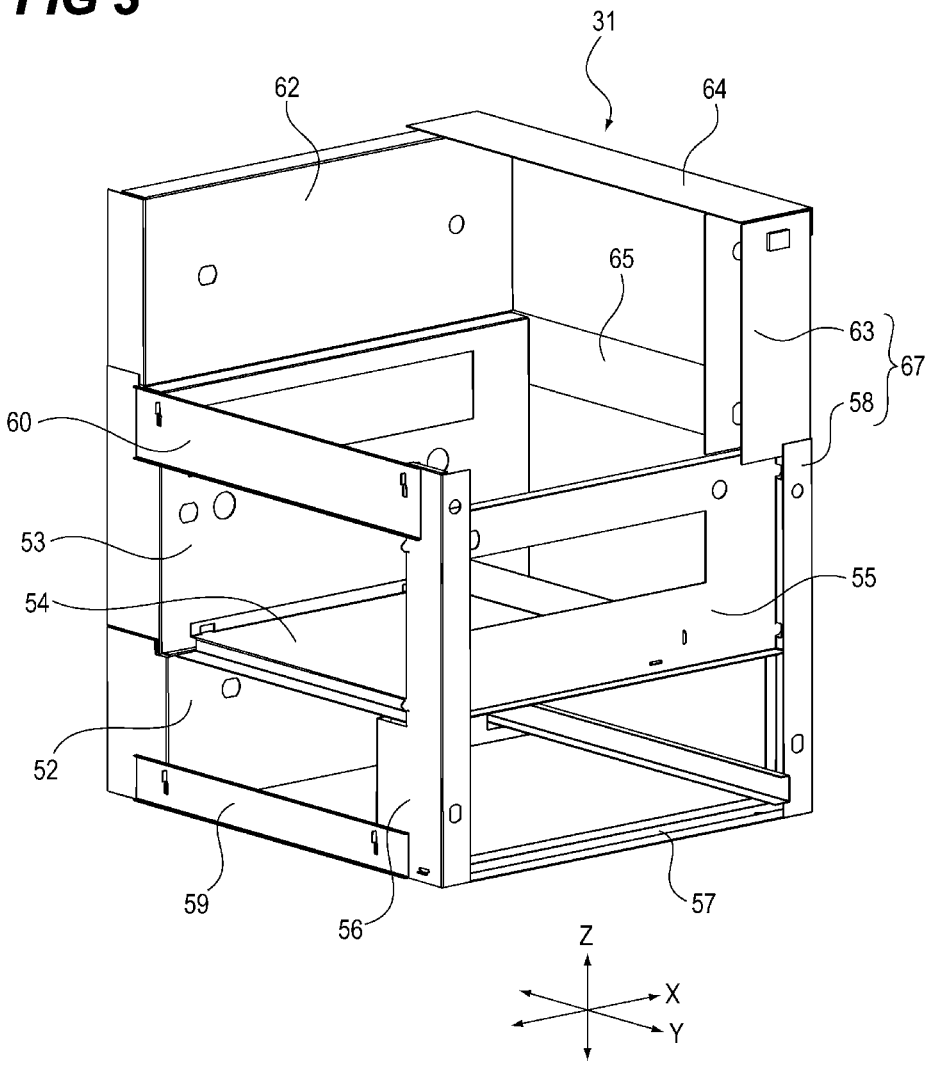
FIG. 3 is a perspective view of the frame of the image forming apparatus.
Figure 4:
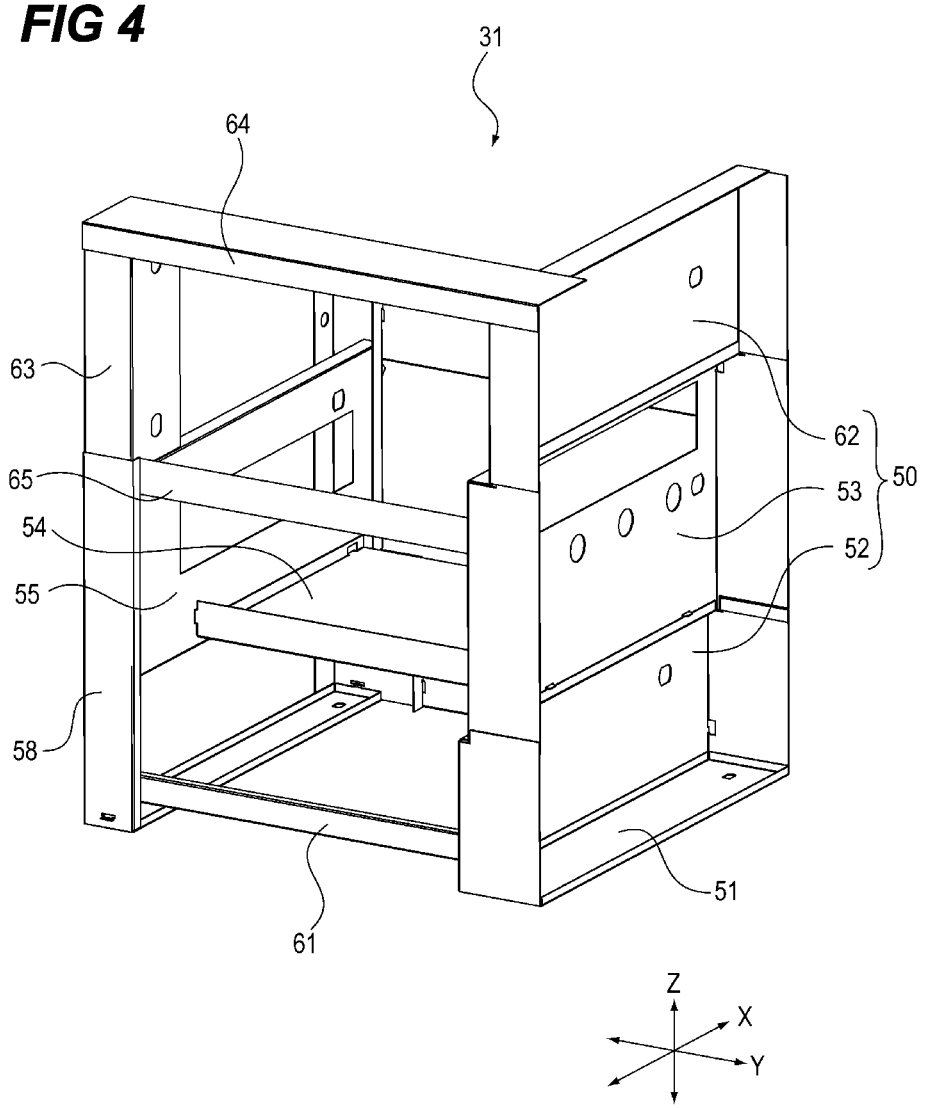
FIG. 4 is a perspective view of the frame of the image forming apparatus.

FIG. 3 is a perspective view of the frame 31 of the image forming apparatus A when viewed from a front surface side of the image forming apparatus A, and is a perspective view of a state where an internal unit such as an image forming unit or an exterior cover is removed from the frame 31. FIG. 4 is a perspective view of the frame 31 of the image forming apparatus A when viewed from a rear surface side of the image forming apparatus A. Note that an arrow X direction illustrated in the drawings is a horizontal direction and indicates a left and right direction of the image forming apparatus A. In addition, an arrow Y direction is a horizontal direction and indicates a front and rear direction of the image forming apparatus A. In addition, an arrow Z direction is a vertical direction and indicates an up and down direction of the image forming apparatus A. In addition, a front side of the image forming apparatus A is a side on which a user normally stands in order to operate an operation portion 46 for performing a setting regarding image formation, and a rear side of the image forming apparatus A is a side opposite to the front side across the frame 31. In addition, a left side of the image forming apparatus A is a left side when viewed from the front side, and a right side of the image forming apparatus A is a right side when viewed from the front side. In addition, the front side of the image forming apparatus A is a direction in which the sheet cassette 42 is pulled out from the image forming apparatus A when the sheet cassette 42 is replenished with sheets, and is a direction in which the toner bottle 32 is pulled out when the toner bottle 32 is replaced.

As illustrated in FIGS. 3 and 4, the image forming apparatus A is the frame 31 on the front side thereof, and includes, as a first support, a front side plate 55 (first side plate), a left support column 56 (second support column), and a right support column 67 (first support column) formed of metal plate. The left support column 56 is connected to one end side of the front side plate 55 in the arrow X direction to support the front side plate 55. The right support column 67 is connected to the other end side of the front side plate 55 in the arrow X direction to support the front side plate 55. In addition, the right support column 67 includes a right support column 58 and a right support column 63 connected to an upper side of the right support column 58 in the vertical direction. The left support column 56 and the right support column 58 are connected to each other by a front lower stay 57.

Further, the image forming apparatus A is the frame 31 on the rear side thereof, and includes, as a second support, a rear side plate 50 and a rear bottom plate 51 formed of metal plate. The rear side plate 50 is arranged to face the front side plate 55, and supports the process cartridge 3 together with the front side plate 55. The rear side plate 50 is divided into three as a rear side plate 52, a rear side plate 53, and a rear side plate 62 in the vertical direction, the rear side plate 53 (second side plate) is connected above the rear side plate 52 in the vertical direction, and the rear side plate 62 is connected above the rear side plate 53 in the vertical direction. In addition, a thickness of the metal plate of each of the rear side plates 52, 53, and 62 is about 0.6 mm to 2 mm.

In addition, the image forming apparatus A includes a left lower stay 59, a left upper stay 60, a right lower stay 61, a right middle stay 65, a right upper stay 64, and a middle stay 54, as the frame 31 connecting the frame 31 on the front surface side and the frame 31 on the rear surface side to each other. Here, each of the left lower stay 59, the left upper stay 60, the right lower stay 61, the right middle stay 65, the right upper stay 64, and the middle stay 54 is an example of a connecting member for connecting the rear side plate 50, which is the frame 31 on the rear surface side, and the front side plate 55, the left support column 56, and the right support column 67, which are the frame 31 on the front surface side, to each other, and is an example of a third support. The left lower stay 59 connects the left support column 56 and the rear side plate 52 to each other. The left upper stay 60 connects the left support column 56 and the rear side plate 53 to each other. The right lower stay 61 connects the right support column 58 and the rear side plate 52 to each other. The right middle stay 65 connects the rear side plate 53 and the right support column 58 to each other. The right upper stay 64 connects the right support column 63 and the rear side plate 62 to each other. The middle stay 54 connects the front side plate 55 and the rear side plate 53 to each other.

Note that each of the members constituting the frame 31 described above is formed of one metal plate. These metal plates are processed into a predetermined shape by drawing or the like, temporarily assembled in an assembly process described later, and then fixed through a fixing process to form the frame 31.

<Frame Assembling Process>

Next, a process of assembling a plurality of metal plates constituting the frame 31 will be described. FIGS. 5 to 27 are views illustrating aspects where the metal plates constituting the frame 31 are assembled.

Figure 5:
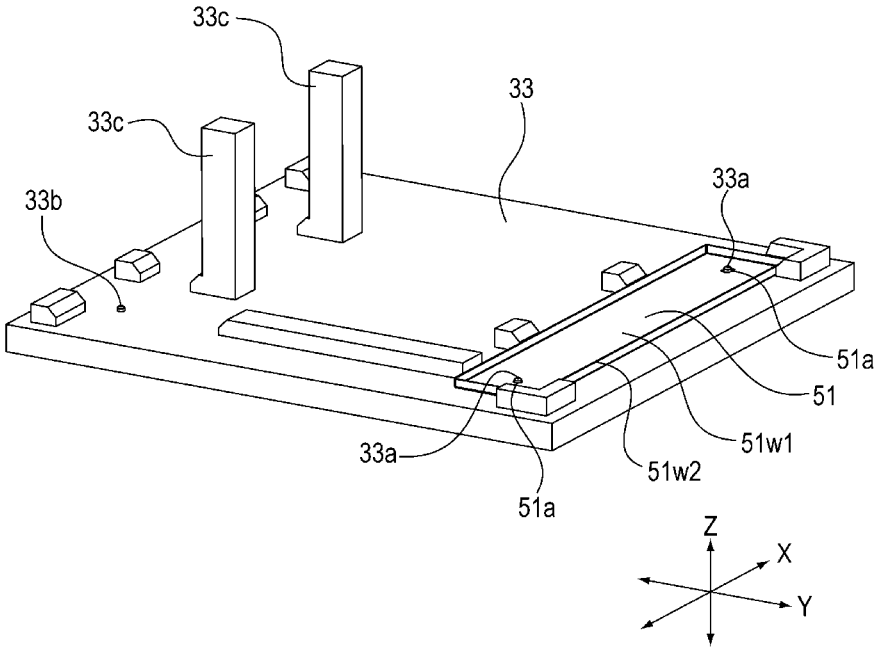
FIG. 5 is a perspective view when a rear bottom plate is assembled.

As illustrated in FIG. 5, a stand 33 as a first jig is used when the metal plates constituting the frame 31 are assembled. The stand 33 has a base portion provided with positioning pins 33*a* and 33*b*, and a support column 33*c* erected on the base portion. First, the rear bottom plate 51 is placed on the stand 33. The rear bottom plate 51 includes a flat surface portion 51*w*1 facing the stand 33, and a bent and raised portion 51*w*2 bent and raised from the flat surface portion 51*w*1. The bent and raised portion 51*w*2 is formed at least on a side engaging with the rear side plate 52. When the rear bottom plate 51 is placed on the stand 33, a position of the rear bottom plate 51 with respect to the stand 33 is determined by inserting the positioning pins 33*a* of the stand 33 into positioning holes 51*a* formed in the flat surface portion 51*w*1 of the rear bottom plate 51.

Figure 6A:
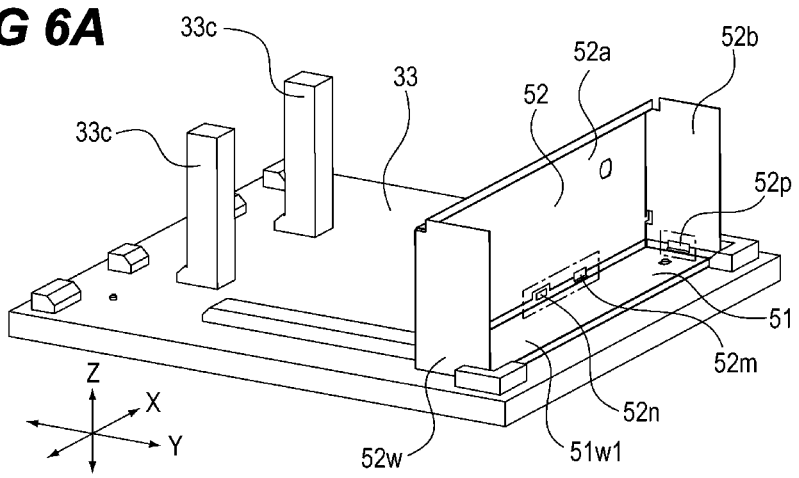
FIGS. 6A to 6C are perspective views when a rear side plate is assembled.
Figure 6B:
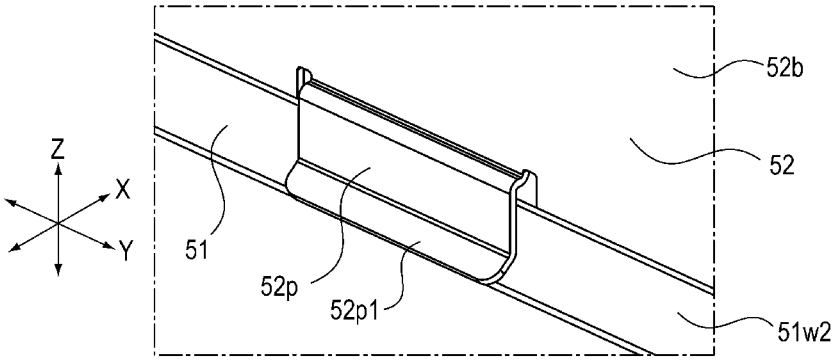
Figure 6C:
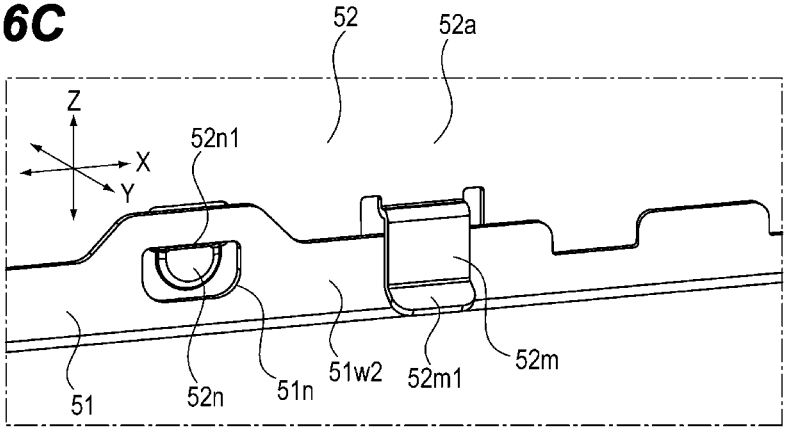

Next, as illustrated in FIGS. 6A to 6C, the rear side plate 52 is assembled. The rear side plate 52 is subjected to bending so as to have a U-shape having three flat surfaces. The rear side plate 52 includes a flat surface portion 52*a* located on a rear surface of the image forming apparatus A, and a bent portion 52*b* bent with respect to the flat surface portion 52*a* and extending rearward of the image forming apparatus A, and a bent portion 52*w* bent with respect to the flat surface portion 52*a* so as to face the bent portion 52*b*. The rear side plate 52 is inserted and assembled into the rear bottom plate 51. A projection portion 52*n* formed so as to protrude by drawing in a plate thickness direction of the flat surface portion 52*a* and a step-bent portion 52*m* are provided at a lower portion of the flat surface portion 52*a* of the rear side plate 52. A step-bent portion 52*p* is provided at a lower portion of the bent portion 52*b* of the rear side plate 52. The step-bent portion 52*m* has a portion bent in the plate thickness direction (arrow Y direction) of the flat surface portion 52*a* and a portion bent and extended from that portion in an insertion direction (arrow Z direction) of the rear side plate 52 into the rear bottom plate 51. The step-bent portion 52*p* has a portion bent in a plate thickness direction (arrow X direction) of the bent portion 52*b* and a portion bent and extended from that portion in the insertion direction of the rear side plate 52 into the rear bottom plate 51. In addition, a tip portion of the step-bent portion 52*m* is an inclined portion 52*m*1 inclined in a direction away from the flat surface portion 52*a* of the rear side plate 52 with respect to the insertion direction of the rear bottom plate 51 into the rear side plate 52. A tip portion of the step-bent portion 52*p* is an inclined portion 52*p*1 inclined in a direction away from the bent portion 52*b* of the rear side plate 52 with respect to the insertion direction of the rear side plate 52 into the rear bottom plate 51. In addition, a through-hole 51*n* penetrating the bent and raised portion 51*w*2 in a plate thickness direction (arrow Y direction) of the bent and raised portion 51*w*2 is formed in the bent and raised portion 51*w*2 of the rear bottom plate 51.

When the rear side plate 52 is assembled, the step-bent portions 52*m* and 52*p* of the rear side plate 52 are inserted into and engaged with the bent and raised portions 51*w*2 of the rear bottom plate 51. At this time, the inclined portions 52*m*1 and 52*p*1 of the rear side plate 52 abut on the bent and raised portions 51*w*2 of the rear bottom plate 51, such that movement of the rear side plate 52 in the arrow Z direction is guided. As a result, the bent and raised portion 51*w*2 of the rear bottom plate 51 is sandwiched from the plate thickness direction of the band and raised portion 51*w*2 by the step-bent portions 52*m* and 52*p*, and the flat surface portions 52*a* and the bent portion 52*b* in the rear side plate 52, such that a position of the rear side plate 52 with respect to the rear bottom plate 51 in the arrow X direction and the arrow Y direction is determined. In addition, the projection portion 52*n* of the rear side plate 52 engages with the through-hole 51*n* of the rear bottom plate 51. As a result, an edge portion 52*n*1 of the projection portion 52*n* abuts on an inner wall of the through-hole 51*n*, such that movement of the rear side plate 52 with respect to the rear bottom plate 51 in a direction opposite to the insertion direction is restricted. In addition, when the rear side plate 52 is inserted into the rear bottom plate 51 up to a position where a lower end portion of the rear side plate 52 abuts on a surface of the stand 33 on which the rear bottom plate 51 is placed or a position where portions of the step-bent portions 52*m* and 52*p* bent and raised from the flat surface portions 52*a* and the bent portion 52*b* abut on an upper end portion of the bent and raised portion 51*w*2 of the rear bottom plate 51, positions of the rear side plate 52 and the rear bottom plate 51 in the arrow Z direction are determined, such that a final relative position between the rear bottom plate 51 and the rear side plate 52 is determined.

Figure 7:
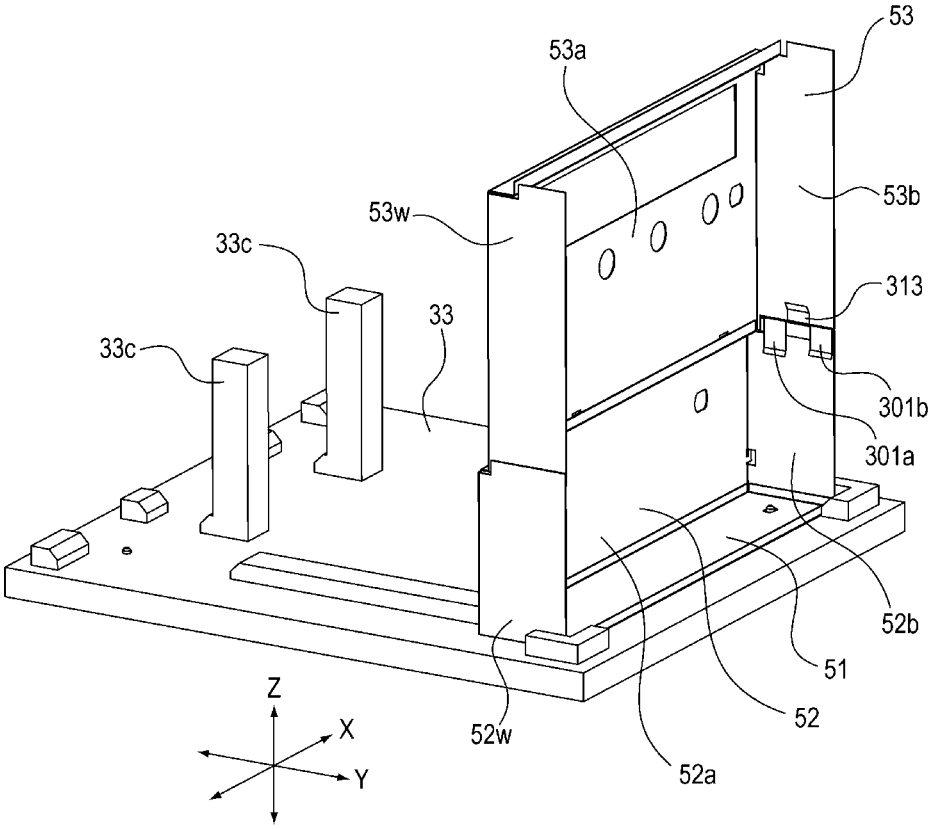
FIG. 7 is a perspective view when the rear side plate is assembled.

Next, as illustrated in FIG. 7, the rear side plate 53 supporting the process cartridge 3 is inserted into the rear side plate 52 from the vertical direction (arrow Z direction) and assembled. The rear side plate 53 is subjected to bending so as to have a U-shape having three flat surfaces. The rear side plate 53 is located on the rear surface of the image forming apparatus A, and includes a support portion 53*a* supporting the process cartridge 3 and a bent portion 53*b* bent at a bending angle of a substantially right angle (89° to 91°) with respect to the support portion 53*a* and extending rearward of the image forming apparatus A. In addition, the rear side plate 53 includes a bent portion 53*w* bent with respect to the support portion 53*a* so as to face the bent portion 53*b*.

The support portion 53*a* of the rear side plate 53 is arranged so as to be adjacent to the flat surface portion 52*a* above the flat surface portion 52*a* of the rear side plate 52 in the vertical direction. Further, the bent portion 53*b* of the rear side plate 53 is arranged so as to be adjacent to the bent portion 52*b* in the vertical direction with respect to the bent portion 52*b* of the rear side plate 52. Further, the bent portion 53*w* of the rear side plate 53 is arranged so as to be adjacent to the bent portion 52*w* in the vertical direction with respect to the bent portion 52*w* of the rear side plate 52.

Figure 8A:
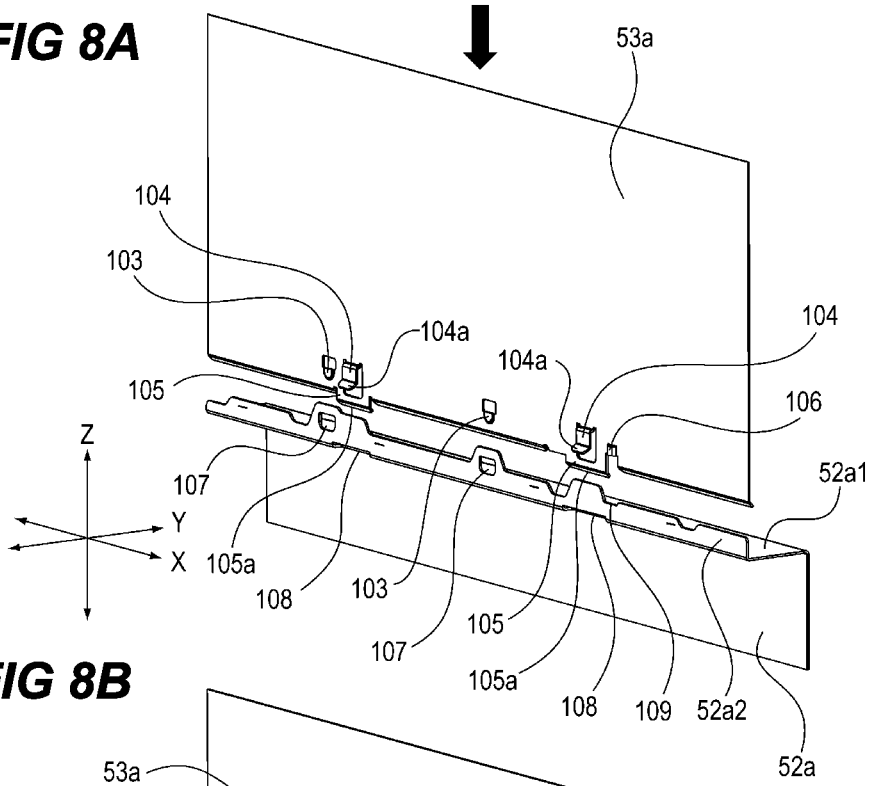
FIGS. 8A and 8B are perspective views of a support portion of the rear side plate.
Figure 8B:
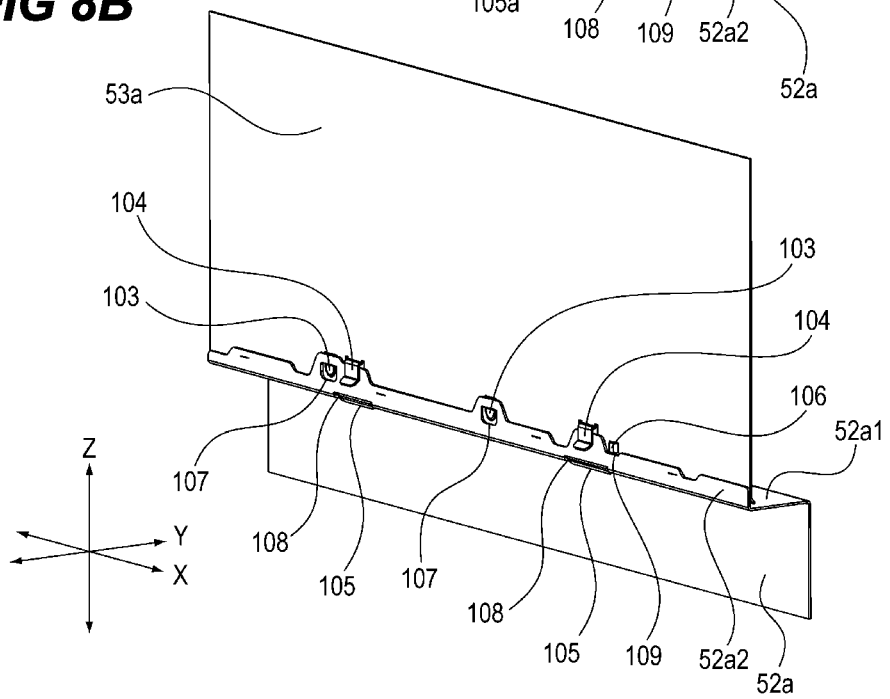

First, an assembly configuration of the flat surface portion 52*a* of the rear side plate 52 and the support portion 53*a* of the rear side plate 53 will be described. FIGS. 8A and 8B are perspective views of the flat surface portion 52*a* of the rear side plate 52 and the support portion 53*a* of the rear side plate 53. Here, FIG. 8A illustrates a state before the rear side plate 52 and the rear side plate 53 are assembled to each other, and FIG. 8B illustrates a state where the rear side plate 52 and the rear side plate 53 are assembled to each other.

As illustrated in FIGS. 8A and 8B, the support portion 53*a* of the rear side plate 53 is provided with two projection portions 103 protruding in a plate thickness direction of the rear side plate 53 and two step-bent portion 104 protruding in an insertion direction (arrow Z direction) of the rear side plate 53 into the rear side plate 52. In addition, two protrusion portions 105 protruding in the insertion direction of the rear side plate 53 into the rear side plate 52 are provided below the two step-bent portions 104.

The projection portion 103 is formed by drawing, and the amount of protrusion from the surface of the support portion 53*a* is about 0.3 mm to 2 mm. In addition, the projection portion 103 is arranged at a position adjacent to the step-bent portion 104 in a direction (arrow X direction) orthogonal to the plate thickness direction of the rear side plate 53 and the insertion direction of the rear side plate 53 into the rear side plate 52. In addition, a tip portion of the protrusion portion 105 is an inclined portion 105*a* inclined in a direction away from the support portion 53*a* with respect to the insertion direction of the rear side plate 53 into the rear side plate 52.

The step-bent portion 104 has a portion bent in the plate thickness direction of the rear side plate 53 and a portion bent and extended from that portion in the insertion direction of the rear side plate 53 into the rear side plate 52. In addition, a tip portion of the step-bent portion 104 is an inclined portion 104*a* inclined in a direction away from the support portion 53*a* of the rear side plate 53 with respect to the insertion direction of the rear side plate 53 into the rear side plate 52.

A bent portion 52*a*1 bent in the arrow Y direction and a bent and raised portion 52*a*2 bent and raised from the bent portion 52*a*1 in the arrow Z direction are formed at an upper portion of the flat surface portion 52*a* of the rear side plate 52. Two through-holes 107 penetrating the bent and raised portion 52*a*2 in a plate thickness direction (arrow Y direction) of the bent and raised portion 52*a*2 are formed in the bent and raised portion 52*a*2. In addition, through-holes 108 penetrating a boundary portion between the bent portion 52*a*1 and the bent and raised portion 52*a*2 in a plate thickness direction thereof are formed at the boundary portion.

When the rear side plate 53 is assembled to the rear side plate 52, the inclined portion 104*a* of the step-bent portion 104 and the inclined portion 105*a* of the protrusion portion 105 of the rear side plate 53 abut on the bent and raised portion 52*a*2 of the rear side plate 52, such that movement of the rear side plate 53 in the arrow Z direction is guided. In addition, a stopper portion 106 of the rear side plate 53 abuts on an abutting portion 109, which is an upper end portion of the bent and raised portion 52*a*2 of the rear side plate 52, such that movement of the rear side plate 53 with respect to the rear side plate 52 in the insertion direction is restricted.

When the rear side plate 53 is assembled to the rear side plate 52, the step-bent portion 104 of the rear side plate 53 is inserted into and engaged with the bent and raised portion 52*a*2 of the rear side plate 52. As a result, the bent and raised portion 52*a*2 of the rear side plate 52 is sandwiched from the plate thickness direction of the bent and raised portion 52*a*2 by the step-bent portion 104 and the support portion 53*a* in the rear side plate 53, such that a position of the rear side plate 53 with respect to the rear side plate 52 in the arrow Y direction is determined.

In addition, the projection portion 103 of the rear side plate 53 engages with the through-hole 107 of the rear side plate 52. As a result, an edge portion 103*a* of the projection portion 103 abuts on an inner wall of the through-hole 107, such that movement of the rear side plate 53 with respect to the rear side plate 52 in a direction opposite to the insertion direction is restricted.

In addition, the protrusion portion 105 of the rear side plate 53 engages with the through-hole 108 of the rear side plate 52. As a result, the protrusion portion 105 abuts on an inner wall of the through-hole 108, such that movement of the rear side plate 53 respect to the rear side plate 52 in the arrow X direction is restricted.

As described above, the projection portion 52*n* that restricts the movement of the rear side plate 53 with respect to the rear side plate 52 in the direction opposite to the insertion direction is provided in the vicinity of the step-bent portion 104 that engages the rear side plate 52 and the rear side plate 53 with each other. As a result, it is possible to prevent the rear side plate 53 from moving with respect to the rear side plate 52 in the direction opposite to the insertion direction, such that the rear side plate 53 and the rear side plate 52 are separated from each other, resulting in deterioration of position accuracy. Therefore, the rear side plate 53 and the rear side plate 52 that constitute the frame 31 can be assembled to each other with high position accuracy.

Figure 9A:
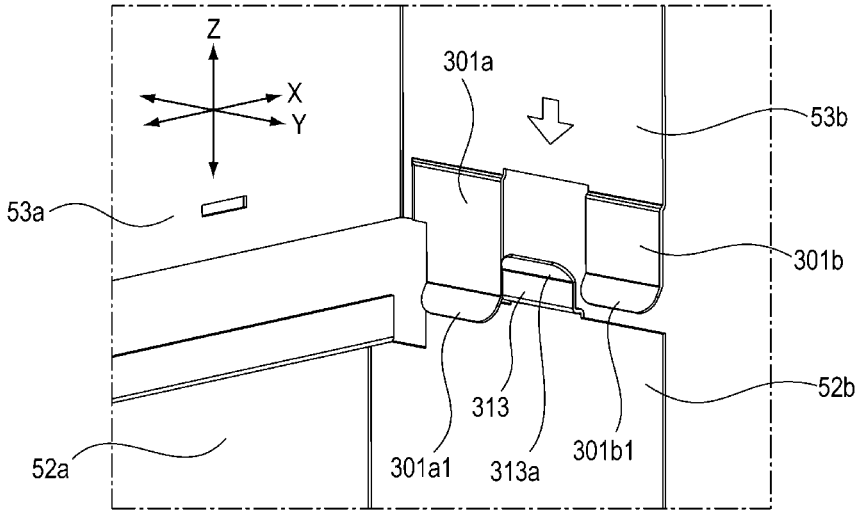
FIGS. 9A and 9B are perspective views of a bent portion of the rear side plate.
Figure 9B:
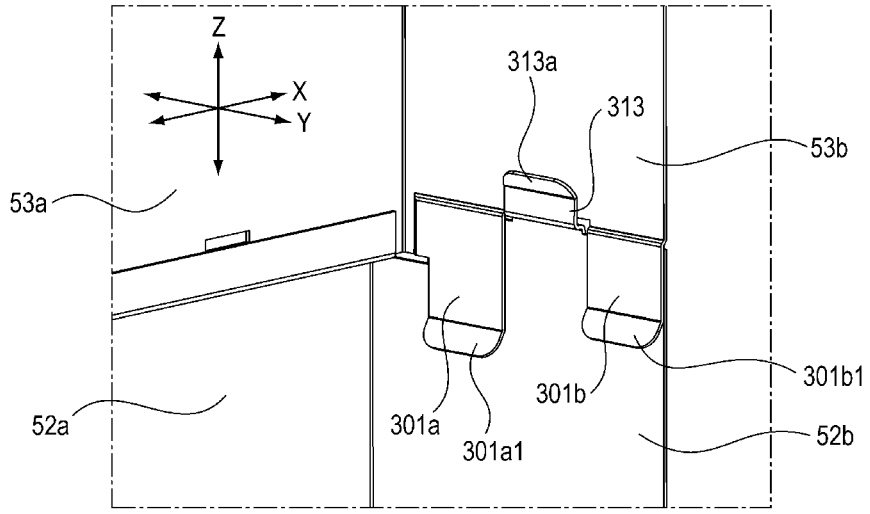

Next, an assembly configuration of the bent portion 52*b* of the rear side plate 52 and the bent portion 53*b* of the rear side plate 53 will be described. FIGS. 9A and 9B are enlarged perspective views of an engaging portion between the bent portion 52*b* of the rear side plate 52 and the bent portion 53*b* of the rear side plate 53. Here, FIG. 9A illustrates a state before the rear side plate 52 and the rear side plate 53 engage with each other, and FIG. 9B illustrates a state in which the rear side plate 52 and the rear side plate 53 engage with each other.

As illustrated in FIGS. 9A and 9B, the bent portion 53*b* of the rear side plate 53 and the bent portion 52*b* of the rear side plate 52 are inserted and assembled into each other. A step-bent portion 313 protruding in an insertion direction (arrow Z direction) into the bent portion 53*b* of the rear side plate 53 and inserted into and engaged with the bent portion 53*b* so as to overlap with the bent portion 53*b* of the rear side plate 53 in a plate thickness direction of the rear side plate 52 is provided at an upper portion of the bent portion 52*b* of the rear side plate 52. The step-bent portion 313 engages with the rear side plate 53 so as to be hooked on a lower end portion of the bent portion 53*b* of the rear side plate 53.

The step-bent portion 313 has a portion bent in the plate thickness direction (arrow X direction) of the bent portion 52*b* of the rear side plate 52 and a portion bent and extended from that portion in the insertion direction into the bent portion 53*b* of the rear side plate 53. In addition, a tip portion of the step-bent portion 313 is an inclined portion 313*a* that is formed to be bent from a portion of the step-bent portion 313 bent in the insertion direction into the bent portion 53*b* of the rear side plate 53 and is inclined in a direction away from the bent portion 52*b* with respect to the insertion direction into the bent portion 53*b*.

In addition, two protrusion portions 301*a* and 301*b* protruding in an insertion direction (arrow Z direction) into the bent portion 52*b* of the rear side plate 52 are provided at a lower portion of the bent portion 53*b* of the rear side plate 53. The protrusion portions 301*a* and 301*b* are inserted into and engaged with the bent portion 52*b* so as to overlap with the bent portion 52*b* of the rear side plate 52 in a plate thickness direction (arrow X direction) of the bent portion 53*b* of the rear side plate 53. In addition, the protrusion portions 301*a* and 301*b* engage with the bent portion 52*b* so as to be hooked on an upper end portion of the bent portion 52*b* of the rear side plate 52. In addition, the protrusion portion 301*b* engages with the bent portion 52*b* so as to be hooked on an upper end portion of the bent portion 52*b* of the rear side plate 52. In addition, tip portions of the protrusion portions 301*a* and 301*b* are inclined portions 301*a*1 and 301*b*1 inclined in a direction away from the bent portion 53*b* with respect to the insertion direction into the bent portion 52*b* into the rear side plate 52.

When the step-bent portion 313 engages with the bent portion 53*b* and the protrusion portions 301*a* and 301*b* engage with the bent portion 52*b*, the step-bent portion 313 and the protrusion portions 301*a* and 301*b* alternately perform engagement in a direction (arrow Y direction) orthogonal to the insertion direction and the plate thickness direction of the bent portions 52*b* and 53*b*. Specifically, the protrusion portion 301*a* is inserted into and engaged with the bent portion 52*b* on a side close to the support portion 53*a* of the rear side plate 53 with respect to the step-bent portion 313 and at a position adjacent to the step-bent portion 313, in the orthogonal direction. That is, the protrusion portion 301*a*, the step-bent portion 313, and the protrusion portion 301*b* are located so as to be arranged adjacent to each other in the direction (arrow Y direction) orthogonal to the vertical direction and the plate thickness direction. The protrusion portion 301*b* is inserted into and engaged with the bent portion 52*b* on a side far from the support portion 53*a* of the rear side plate 53 with respect to the step-bent portion 313 and at a position adjacent to the step-bent portion 313, in the orthogonal direction. With such a configuration, the bent portion 52*b* of the rear side plate 52 and the bent portion 53*b* of the rear side plate 53 are firmly engaged with and assembled to each other. In addition, since the bent portion 52*b* of the rear side plate 52 and the bent portion 53*b* of the rear side plate 53 are assembled to each other by engagement of the bent portions and the plate portions rather than engagement by a through-hole and a protrusion portion, it is not necessary to provide an extra fitting backlash and it is possible to improve positioning accuracy between the metal plates. Therefore, it is possible to achieve both easy assembly of the two metal plates constituting the frame and the improvement of the positioning accuracy between the two metal plates.

Figure 10A:
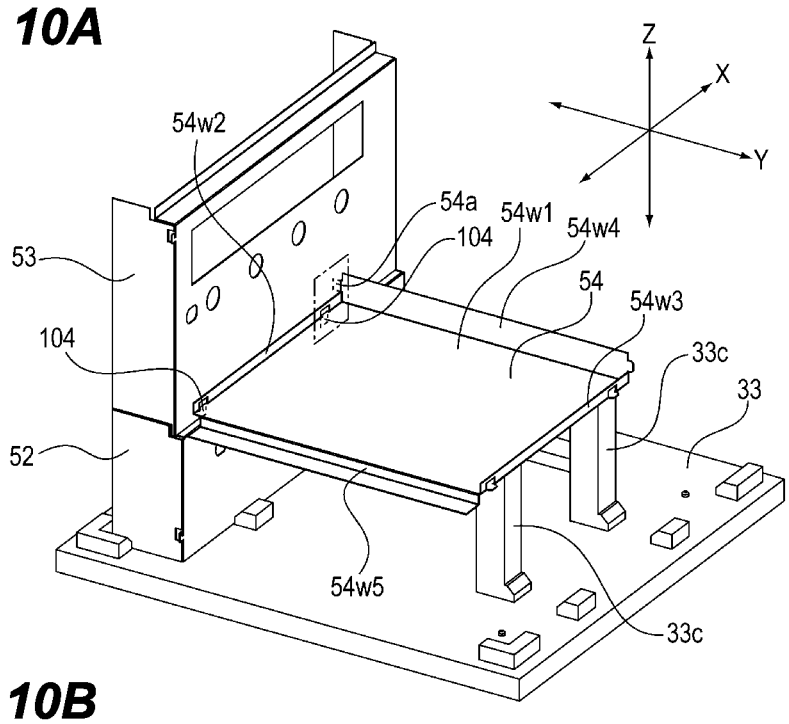
FIGS. 10A and 10B are perspective views when a middle stay is assembled.
Figure 10B:
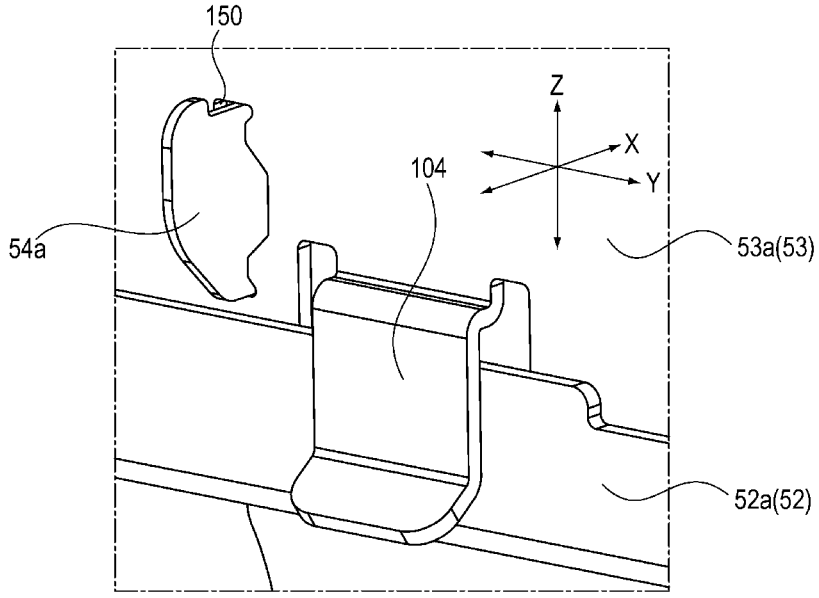

Next, as illustrated in FIGS. 10A and 10B, the middle stay 54 is assembled. The middle stay 54 is an optical stand on which the laser scanner unit 15 is placed, and is one example of the connecting member. The middle stay 54 is arranged on two support columns 33*c* provided on the stand 33, and is inserted into the support portion 53*a* of the rear side plate 53. In the present embodiment, the middle stay 54 is a member that supports the laser scanner unit 15, but may be a member that connects the front side plate 55 and the rear side plate 50 at a predetermined distance at a position between the laser scanner unit 15 and the sheet cassette 42 in the vertical direction. Further, if it is an exposure unit that exposes the photosensitive drum 6 by an LED instead of the laser scanner unit 15, the configuration may be such that it is provided between the exposure unit and the sheet cassette 42 in the vertical direction.

The middle stay 54 has a flat surface portion 54*w*1 extending in the horizontal direction, and a bent and raised portion 54*w*2 bent and raised vertically and upward from the flat surface portion 54*w*1 at one end portion of the flat surface portion 54*w*1 in the arrow Y direction. In addition, the middle stay 54 has a bent and raised portion 54*w*3 bent vertically from the flat surface portion 54*w*1 so as to face the bent and raised portion 54*w*2 and a bent and raised portion 54*w*4 bent vertically and upward from the flat surface portion 54*w*1 at one end portion of the flat surface portion 54*w*1 in the arrow X direction. In addition, the middle stay 54 has a bent portion 54*w*5 bent vertically and downward from the flat surface portion 54*w*1 at the other end portion of the flat surface portion 54*w*1 in the arrow X direction and further extending in the horizontal direction. The bent and raised portion 54*w*4 of the middle stay 54 is provided with a protrusion portion 54*a* protruding in an insertion direction (arrow Y direction) into the rear side plate 53. The protrusion portion 54*a* of the middle stay 54 is inserted into a through-hole 150 formed in the support portion 53*a* of the rear side plate 53 and penetrating the support portion 53*a* in a plate thickness direction (arrow Y direction) of the support portion 53*a*. As a result, a position of the middle stay 54 with respect to the rear side plate 53 in the arrow X direction and the arrow Y direction is determined.

Figure 11A:
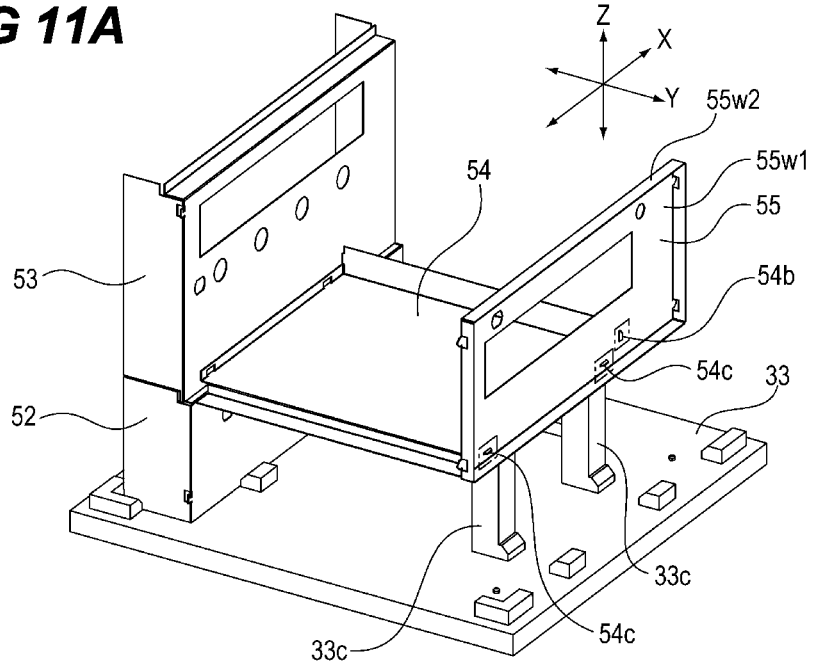
FIGS. 11A to 11C are perspective views when a front side plate is assembled.
Figure 11B:
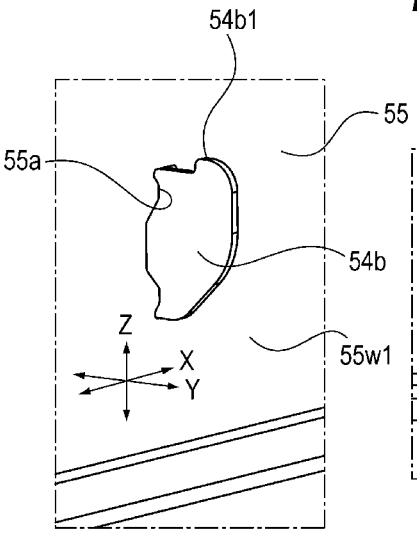
Figure 11C:
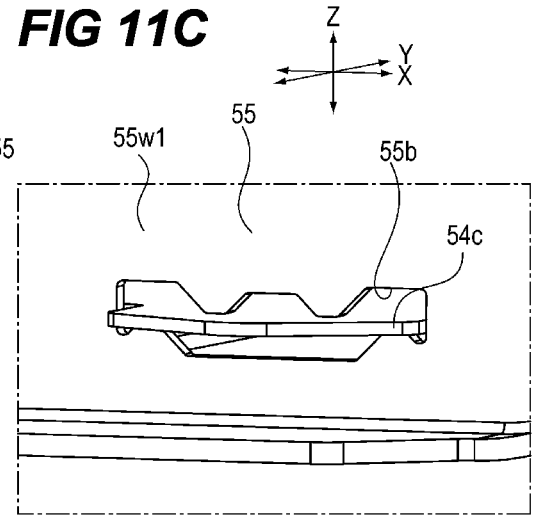

Next, as illustrated in FIGS. 11A to 11C, the front side plate 55 is assembled. The middle stay 54 is inserted into the front side plate 55. The front side plate 55 has a flat surface portion 55*w*1 extending in the vertical direction and a bent and raised portion 55*w*2 formed by bending and raising each of both end portions of the flat surface portion 55*w*1 in the arrow X direction and the arrow Y direction forward of the image forming apparatus A. Through-holes 55*a* and 55*b* penetrating in the plate thickness direction (arrow Y direction) thereof is formed in the flat surface portion 55*w*1 of the front side plate 55. In addition, the bent and raised portion 54*w*3 of the middle stay 54 is provided with protrusion portions 54*b* and 54*c* protruding in an insertion direction (arrow Y direction) into the front side plate 55. A tip portion of the protrusion portion 54*b* is provided with a hook portion 54*b*1 protruding upward of a base end portion.

The protrusion portion 54*b* of the middle stay 54 is inserted into the through-hole 55*a* formed in the flat surface portion 55*w*1 of the front side plate 55, and the protrusion portion 54*c* of the middle stay 54 is inserted into the through-hole 55*b* formed in the flat surface portion 55*w*1 of the front side plate 55. As a result, a position of the front side plate 55 with respect to the middle stay 54 is determined. In addition, the hook portion 54*b*1 of the protrusion portion 54*b* faces an upper portion of the through-hole 55*a* in the front side plate 55. As a result, the hook portion 54*b*1 of the middle stay 54 abuts on the flat surface portion 55*w*1 of the front side plate 55, such that movement of the middle stay 54 with respect to the front side plate 55 in a direction opposite to the insertion direction is restricted and the middle stay 54 is prevented from being separated.

Figure 12A:
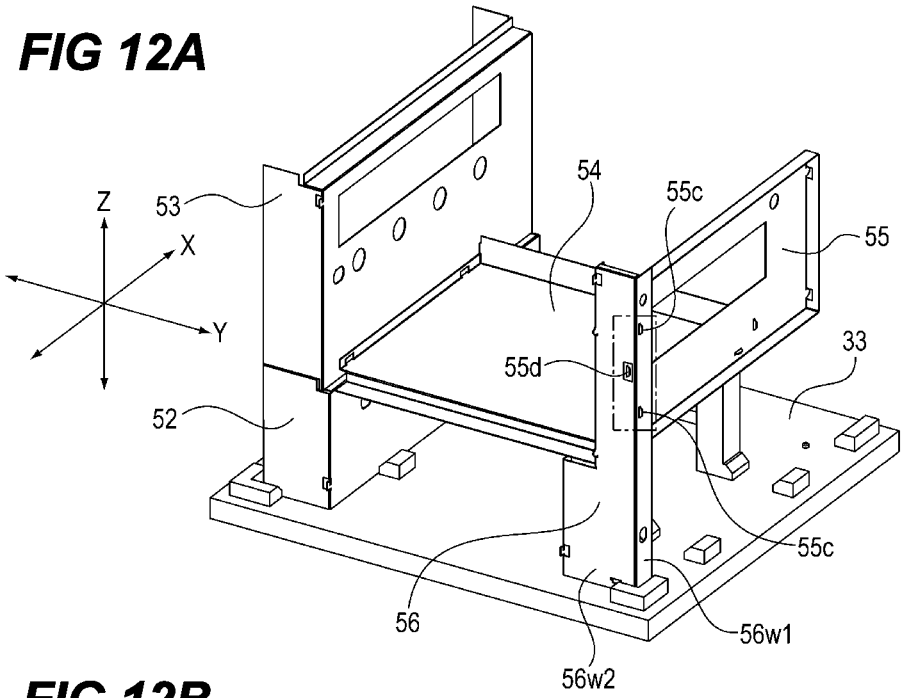
FIGS. 12A and 12B are perspective views when a left support column is assembled.
Figure 12B:
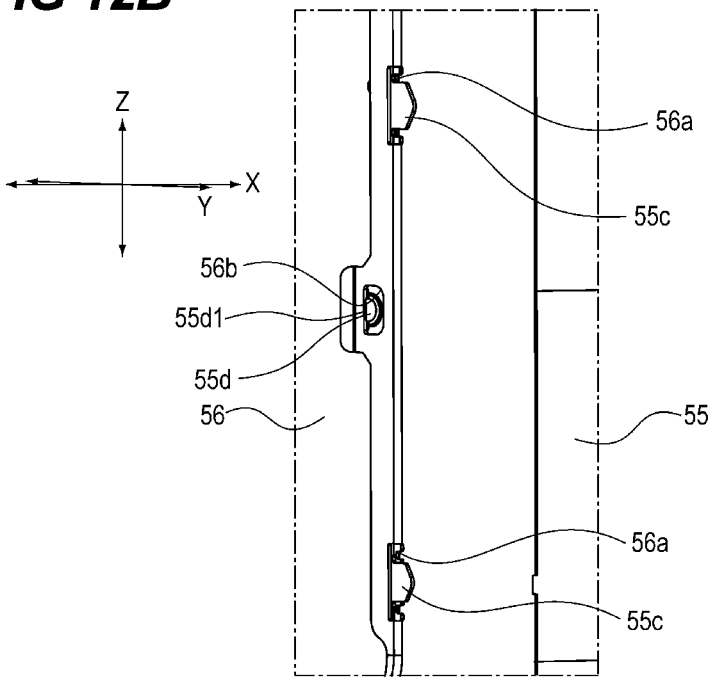

Next, as illustrated in FIGS. 12A and 12B, the left support column 56 is assembled. The left support column 56 is arranged on the stand 33. In addition, the front side plate 55 is inserted into the left support column 56. The left support column 56 is mainly formed of two flat surfaces, and has a flat surface portion 56*w*1 extending in parallel with the flat surface portion 55*w*1 of the front side plate 55 and a flat surface portion 56*w*2 bent substantially vertically from the flat surface portion 56*w*1 rearward of the image forming apparatus A. A through-hole 56*a* penetrating in the arrow Y direction is provided at the bent portion of the boundary between the flat surface portion 56*w*1 and the flat surface portion 56*w*2 of the left support column 56. In addition, the flat surface portion 56*w*2 of the left support column 56 is provided with a through-hole 56*b* penetrating the flat surface portion 56*w*2 in a plate thickness direction (arrow X direction) of the flat surface portion 56*w*2. In addition, the bent and raised portion 55*w*2 of the front side plate 55 is provided with protrusion portions 55*c* protruding in an insertion direction (arrow Y direction) into the left support column 56 and a projection portion 55*d* protruding in a plate thickness direction (arrow X direction).

The protrusion portion 55*c* of the front side plate 55 is inserted into the through-hole 56*a* formed in the left support column 56. As a result, a position of the left support column 56 with respect to the front side plate 55 is determined. In addition, the projection portion 55*d* of the front side plate 55 engages with the through-hole 56*b* of the left support column 56. As a result, an edge portion 55*d*1 of the projection portion 55*d* abuts on an inner wall of the through-hole 56*b*, such that movement of the front side plate 55 with respect to the left support column 56 in a direction opposite to the insertion direction is restricted.

Figure 13A:
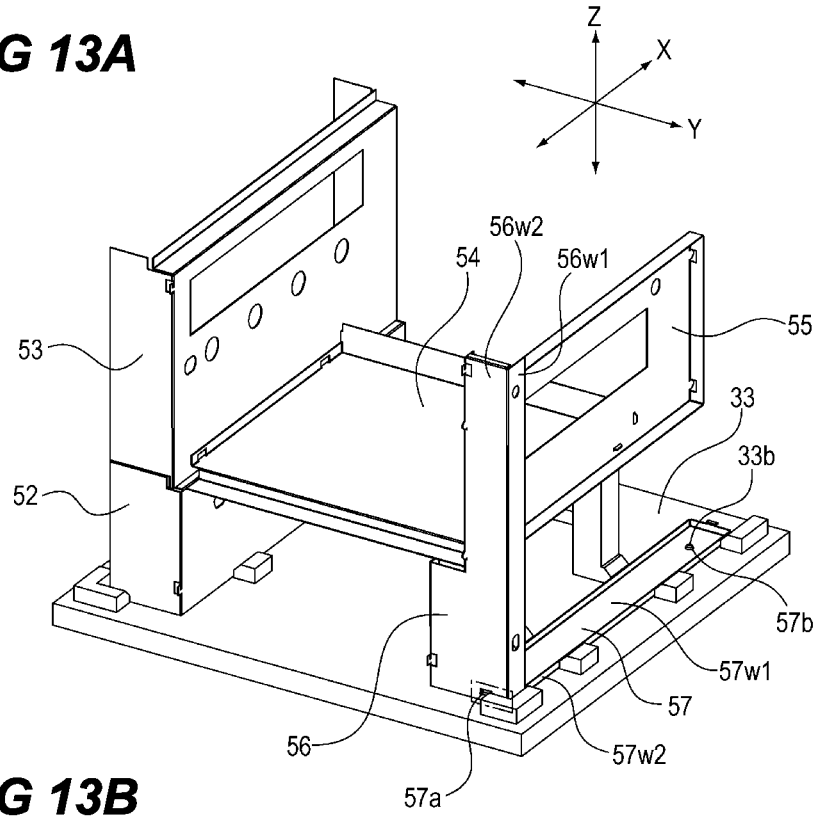
FIGS. 13A and 13B are perspective views when a front lower stay is assembled.
Figure 13B:
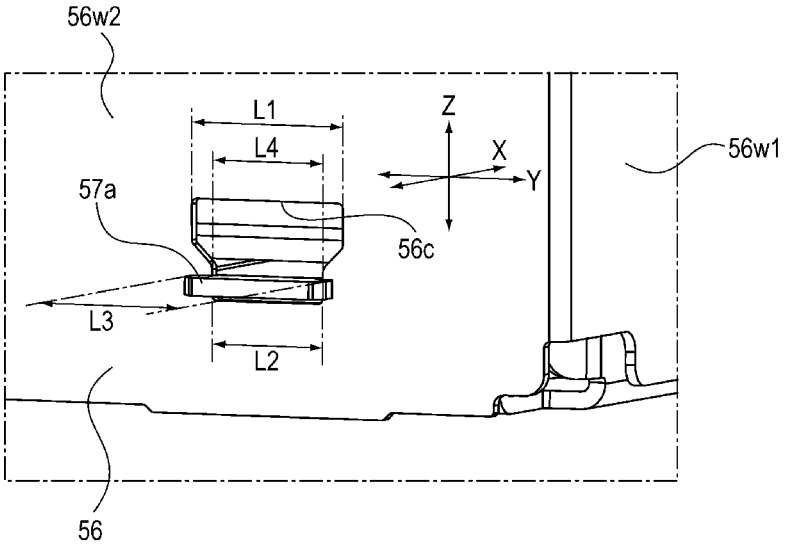

Next, as illustrated in FIGS. 13A and 13B, the front lower stay 57 is assembled. The front lower stay 57 is arranged on the stand 33, and is inserted and assembled into the left support column 56. The front lower stay 57 has a flat surface portion 57*w*1, which is a flat surface to be placed on the stand 33, and a bent and raised portion 57*w*2 formed by bending and raising each of both end portions of the flat surface portion 57*w*1 in the arrow X direction and the arrow Y direction substantially vertically and upward from the flat surface portion 57*w*1. The bent and raised portion 57*w*2 of the front lower stay 57 is provided with a protrusion portion 57*a* protruding in an insertion direction (arrow X direction) into the left support column 56. Positioning holes 57*b* penetrating the flat surface portion 57*w*1 in a plate thickness direction (arrow Z direction) of the flat surface portion 57*w*1 are formed in the flat surface portion 57*w*1 of the front lower stay 57. In addition, the flat surface portion 56*w*2 of the left support column 56 is provided with a through-hole 56*c* penetrating the flat surface portion 56*w*2 in a plate thickness direction (arrow X direction) of the flat surface portion 56*w*2. Here, the width of the upper end portion of the through-hole 56*c* is L1 and the width of the lower end portion is L2. In addition, the width of the tip portion of the protrusion portion 57*a* is L3, and the width of the substrate portion is L4. At this time, the relationship is $L1>L2$, $L4<L3$, $L1\approx L3$, and $L2\approx L4$.

The protrusion portion 57*a* of the front lower stay 57 is inserted into and engaged with a through-hole 56*c* formed in the flat surface portion 56*w*2 of the left support column 56.

At this time, the protrusion portion 57*a* is inserted from an upper side of the through-hole 56*c*, and then moved to the lower end portion of the through-hole 56*c* by the force or gravity of an assembly operator. Here, when the protrusion portion 57*a* is located at a lower end portion of the through-hole 56*c*, movement of the protrusion portion 57*a* with respect to the through-hole 56*c* in a direction opposite to the insertion direction is restricted by the relationship of L3>L2. In addition, when the front lower stay 57 is arranged on the stand 33, the positioning pins 33*b* of the stand 33 are inserted into the positioning holes 57*b* of the front lower stay 57. As a result, a position of the front lower stay 57 with respect to the stand 33 is determined.

Figure 14:
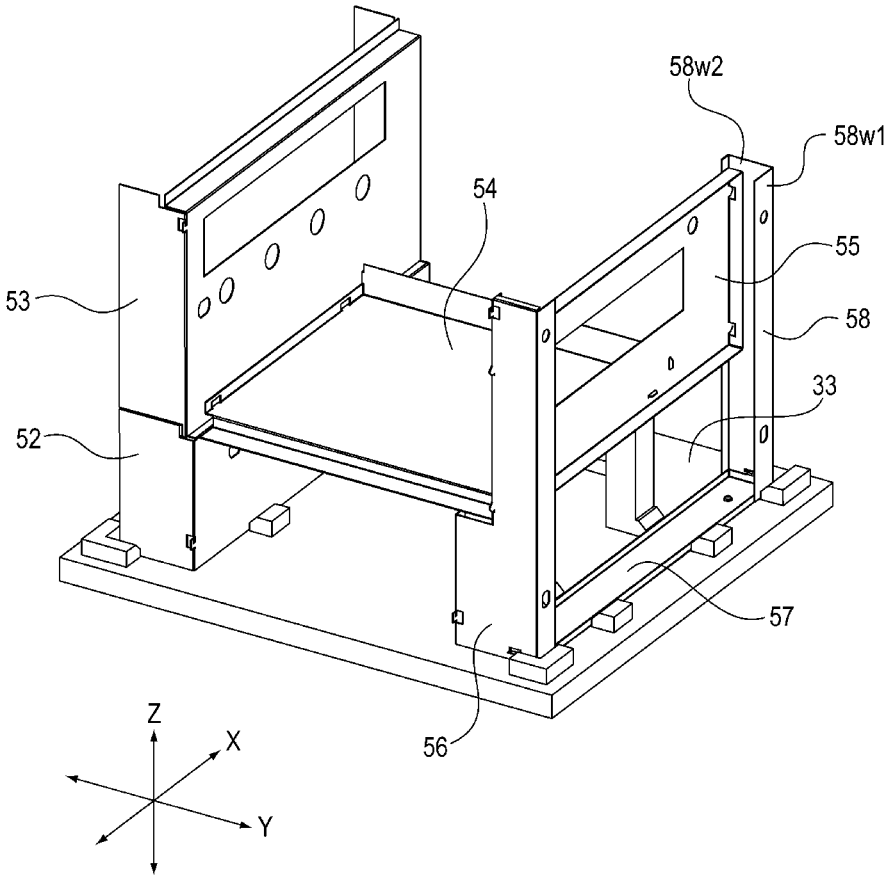
FIG. 14 is a perspective view when a right support column is assembled.

Next, as illustrated in FIG. 14, the right support column 58 is assembled. The right support column 58 is arranged on the stand 33. In addition, the front side plate 55 is inserted and assembled into the right support column 58. The right support column 58 has a flat surface portion 58*w*1 extending in parallel with the flat surface portion 55*w*1 of the front side plate 55 and a flat surface portion 58*w*2 bent substantially vertically from the flat surface portion 58*w*1 forward of the image forming apparatus A. An assembly configuration of the right support column 58 and the front side plate 55 is similar to that of the left support column 56 and the front side plate 55. That is, a through-hole (not illustrated) penetrating a bent portion of a boundary between the flat surface portion 58*w*1 and the flat surface portion 58*w*2 of the right support column 58 in the arrow Y direction is formed in the bend portion. A protrusion portion (not illustrated) formed in the bent and raised portion 55*w*2 of the front side plate 55 and protruding in an insertion direction (arrow Y direction) into the right support column 58 is inserted into this through-hole. In addition, the flat surface portion 58*w*2 of the right support column 58 is provided with a through-hole (not illustrated) penetrating the flat surface portion 58*w*2 in a plate thickness direction (arrow X direction) of the flat surface portion 58*w*2. A projection portion (not illustrated) formed in the bent and raised portion 55*w*2 of the front side plate 55 and protruding in the arrow X direction engages with this through-hole. Here, the left support column 56 and the right support column 58 are assembled after assembling the front side plate 55 to the middle stay 54, but the front side plate 55 is attached to the middle stay 54 with the left support column 56 mounted on the stand 33 in the order of assembling to the left support column 56.

At a point in time when the frame 31 is assembled up to now, the frame 31 can stand for oneself. That is, the frame 31 can stand for oneself by assembling the front side plate 55, the right support column 58, the left support column 56, the front lower stay 57, which are the frame 31 on the front surface side of the image forming apparatus A, the rear bottom plate 51 and the rear side plates 52 and 53, which are the frame on the rear surface side of the image forming apparatus A, and the middle stay 54, which is the frame 31 connecting the frame on the front surface side and the frame on the rear surface side to each other, to each other.

Figure 15A:
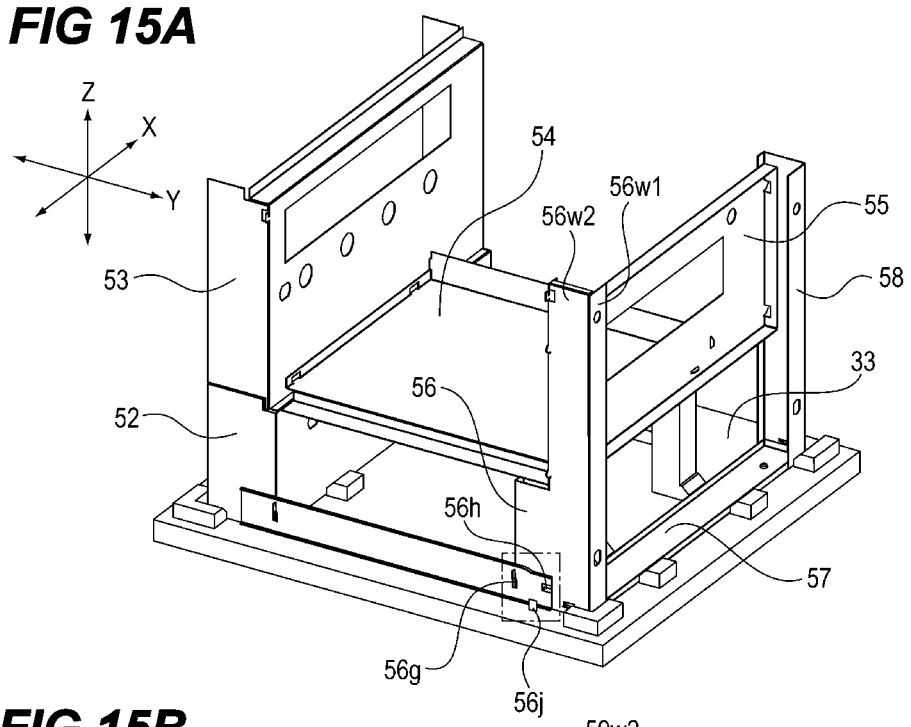
FIGS. 15A and 15B are perspective views when a left lower stay is assembled.
Figure 15B:
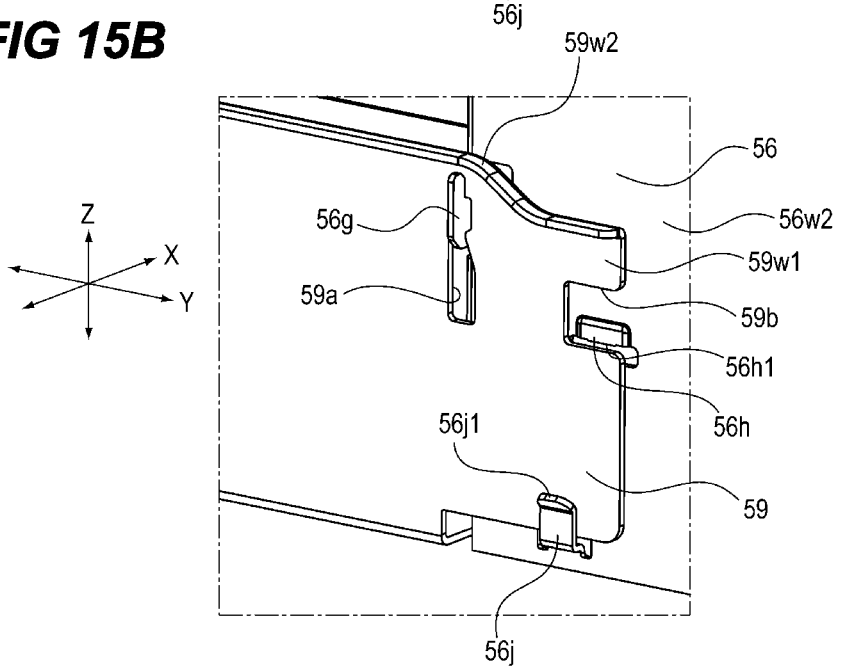

Next, as illustrated in FIGS. 15A and 15B, the left lower stay 59 is assembled. The left lower stay 59 has a flat surface portion 59*w*1 extending in parallel with the flat surface portion 56*w*2 of the left support column 56, and a bent and raised portion 59*w*2 bent in the plate thickness direction (arrow X direction) of the flat surface portion 59*w*1 at the upper part of the flat surface portion 59*w*1. The left lower stay 59, and the rear side plate 52 and the left support column 56 are inserted and assembled into each other from the vertical direction. An assembly configuration of the left lower stay 59 and the left support column 56 and an assembly configuration of the left lower stay 59 and the rear side plate 52 are similar to each other. Therefore, only the assembly configuration of the left lower stay 59 and the left support column 56 will be described here.

The flat surface portion 56*w*2 of the left support column 56 is provided with a protrusion portion 56*g* and a step-bent portion 56*j* that protrude in an insertion direction (arrow Z direction) into the left lower stay 59 and a projection portion 56*h* that protrudes in a plate thickness direction (arrow X direction) of the flat surface portion 56*w*2. The step-bent portion 56*j* has a portion bent in the plate thickness direction of the flat surface portion plate 56*w*2 and a portion bent and extended from that portion in the insertion direction into the left lower stay 59. In addition, a tip portion of the step-bent portion 56*j* is an inclined portion 56*j*1 inclined in a direction away from the flat surface portion 56*w*2 with respect to the insertion direction of the left support column 56 into the left lower stay 59. In addition, a through-hole 59*a* penetrating the flat surface portion 59*w*1 in the plate thickness direction (arrow X direction) of the flat surface portion 59*w*1 and a notch portion 59*b* notched in the flat surface direction are formed in the flat surface portion 59*w*1 of the left lower stay 59.

The protrusion portion 56*g* of the left support column 56 is inserted into and engaged with the through-hole 59*a* formed in the flat surface portion 59*w*1 of the left lower stay 59. Here, the width of the protrusion portion 56*g* in the arrow Y direction and the width of the through-hole 59*a* in the arrow Y direction are almost the same. Therefore, the protrusion portion 56*g* is inserted into the through-hole 59*a*, such that a position of the left lower stay 59 with respect to the left support column 56 in the arrow Y direction is determined.

In addition, the step-bent portion 56*j* of the left support column 56 is inserted into and engaged with a lower end portion of the flat surface portion 59*w*1 of the left lower stay 59. As a result, the flat surface portion 59*w*1 of the left lower stay 59 is sandwiched from the plate thickness direction (arrow X direction) of the flat surface portion 59*w*1 by the step-bent portion 56*j* and the flat surface portion 56*w*2 in the left support column 56, such that a position of the left lower stay 59 with respect to the left support column 56 in the arrow X direction is determined.

In addition, the projection portion 56*h* of the left support column 56 engages with the notch portion 59*b* formed in the left lower stay 59. As a result, an edge portion 56*h*1 of the projection portion 56*h* abuts on an inner wall of the notch portion 59*b*, such that movement of the left support column 56 with respect to the left lower stay 59 in a direction opposite to the insertion direction is restricted.

Figure 16A:
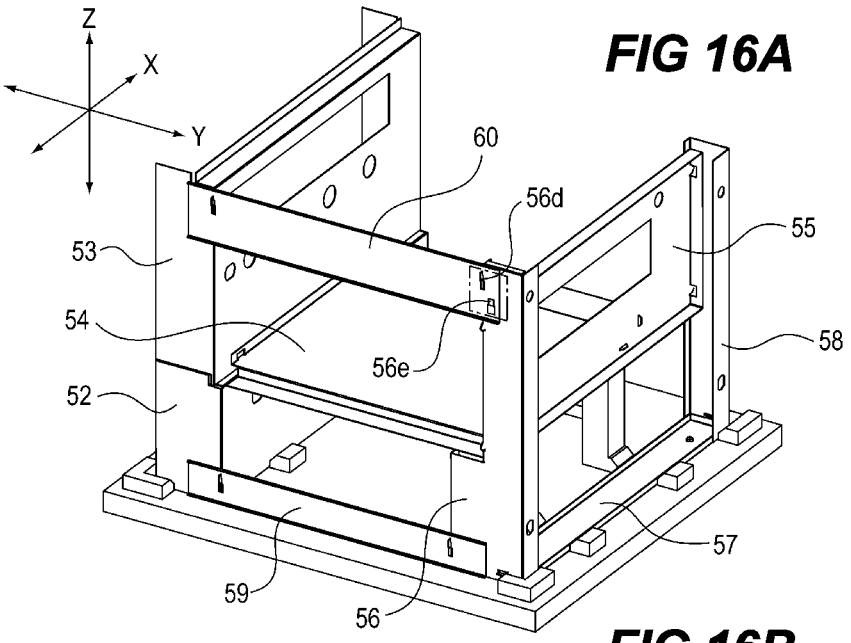
FIGS. 16A and 16B are perspective views when a left upper stay is assembled.
Figure 16B:
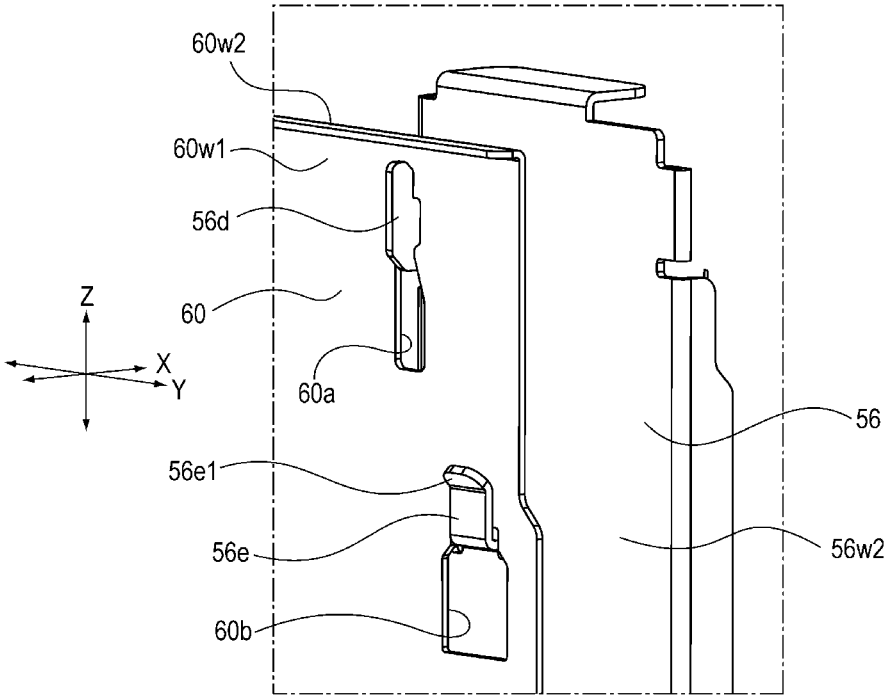

Next, as illustrated in FIGS. 16A and 16B, the left upper stay 60 is assembled. The left lower stay 59, and the rear side plate 53 and the left support column 56 are inserted and assembled into each other from the vertical direction. An assembly configuration of the left upper stay 60 and the rear side plate 53 and an assembly configuration of the left upper stay 60 and the left support column 56 are similar to each other. Therefore, only the assembly configuration of the left upper stay 60 and the left support column 56 will be described here.

A protrusion portion 56*d* and a step-bent portion 56*e* that protrude in an insertion direction (arrow Z direction) into the left upper stay 60 are formed in the flat surface portion 56*w*2 of the left support column 56. The step-bent portion 56*e* has a portion bent in the plate thickness direction (arrow X direction) of the flat surface portion plate 56*w*2 of the left support column 56 and a portion bent and extended from that portion in the insertion direction into the left upper stay 60. In addition, a tip portion of the step-bent portion 56*e* is an inclined portion 56*e*1 inclined in a direction away from the flat surface portion 56*w*2 with respect to the insertion direction of the left support column 56 into the left upper stay 60.

The left upper stay 60 has a flat surface portion 60*w*1 extending in parallel with the flat surface portion 56*w*2 of the left support column 56, and a bent and raised portion 60*w*2 bent in the plate thickness direction (arrow X direction) of the flat surface portion 60*w*1 at the upper part of the flat surface portion 60*w*1. Through-hole 60*a* and 60*b* penetrating the flat surface portion 60*w*1 in the plate thickness direction (arrow X direction) thereof is formed in the flat surface portion 60*w*1 of the left upper stay 60.

The protrusion portion 56*d* of the left support column 56 is inserted into and engaged with the through-hole 60*a* formed in the flat surface portion 60*w*1 of the left upper stay 60. Here, the width of the protrusion portion 56*d* in the arrow Y direction and the width of the through-hole 60*a* in the arrow Y direction are almost the same. Therefore, the protrusion portion 56*d* is inserted into the through-hole 60*a*, such that a position of the left upper stay 60 with respect to the left support column 56 in the arrow Y direction is determined. In addition, the step-bent portion 56*e* of the left support column 56 is inserted into and engaged with the through-hole 60*b* of the left upper stay 60. As a result, the flat surface portion 60*w*1 of the left upper stay 60 is sandwiched from the plate thickness direction (arrow X direction) of the flat surface portion 60*w*1 by the step-bent portion 56*e* and the flat surface portion 56*w*2 in the left support column 56, such that a position of the left upper stay 60 with respect to the left support column 56 in the arrow X direction is determined.

Figure 17:
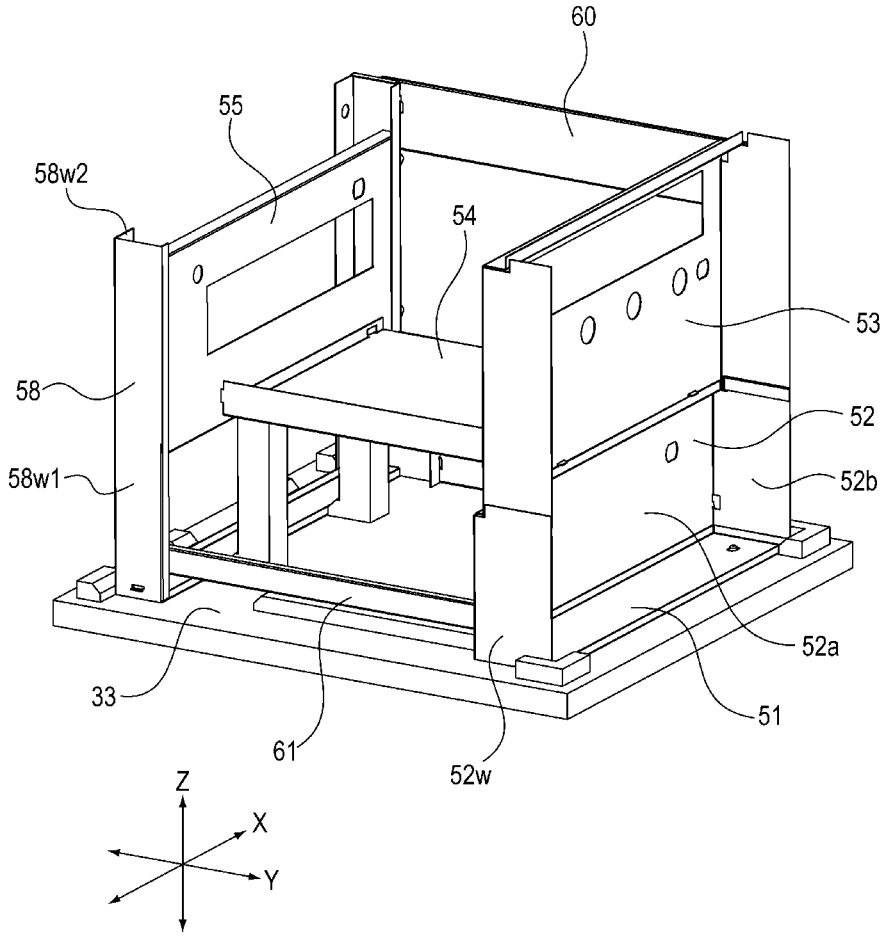
FIG. 17 is a perspective view when a right lower stay is assembled.

Next, as illustrated in FIG. 17, the right lower stay 61 is assembled. The right lower stay 61 is a member connecting between the rear side plate 52 and the right support column 58 facing each other, and is inserted and assembled into the rear side plate 52 and the right support column 58 from a front side where the right support column 58 is located, in the horizontal direction (arrow Y direction). The right lower stay 61 is a member connected to the right support column 58 and the rear side plate 52 so that an interval between the right support column 58 and the rear side plate 52 becomes a predetermined interval, and guaranteeing a conveyance property of the sheet S. In addition, since the right lower stay 61 is located in the vicinity of a right lower corner of the frame 31, the right lower stay 61 has an influence on rigidity of the frame 31. Therefore, it is particularly desirable that the right lower stay 61 is assembled with high position accuracy. Hereinafter, an assembly configuration of the right lower stay 61 will be described in detail.

Figure 18A:
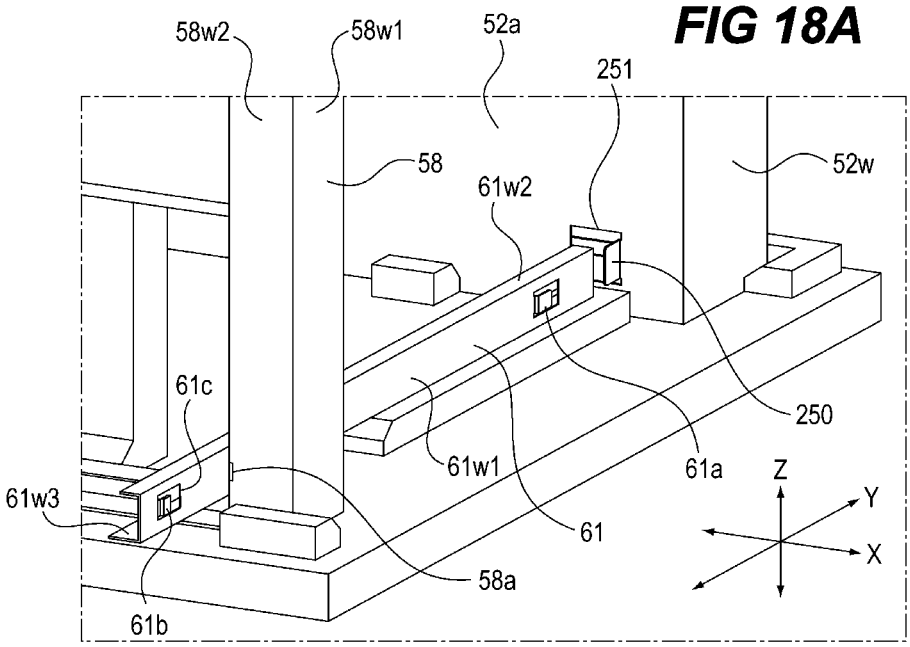
FIGS. 18A and 18B are perspective views of the right lower stay, the rear side plate, and the right support column.
Figure 18B:
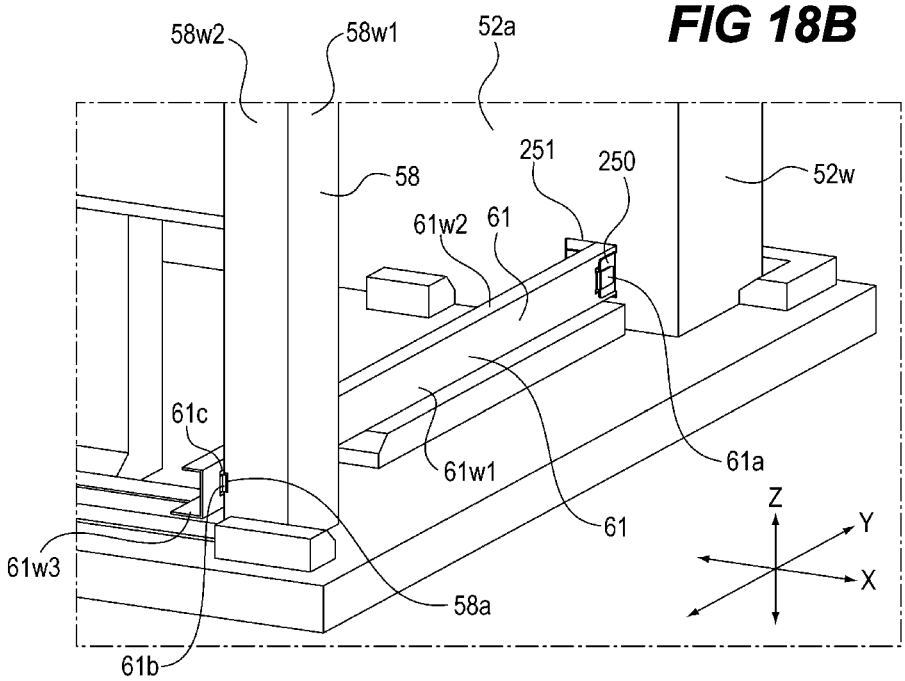
Figure 25A:
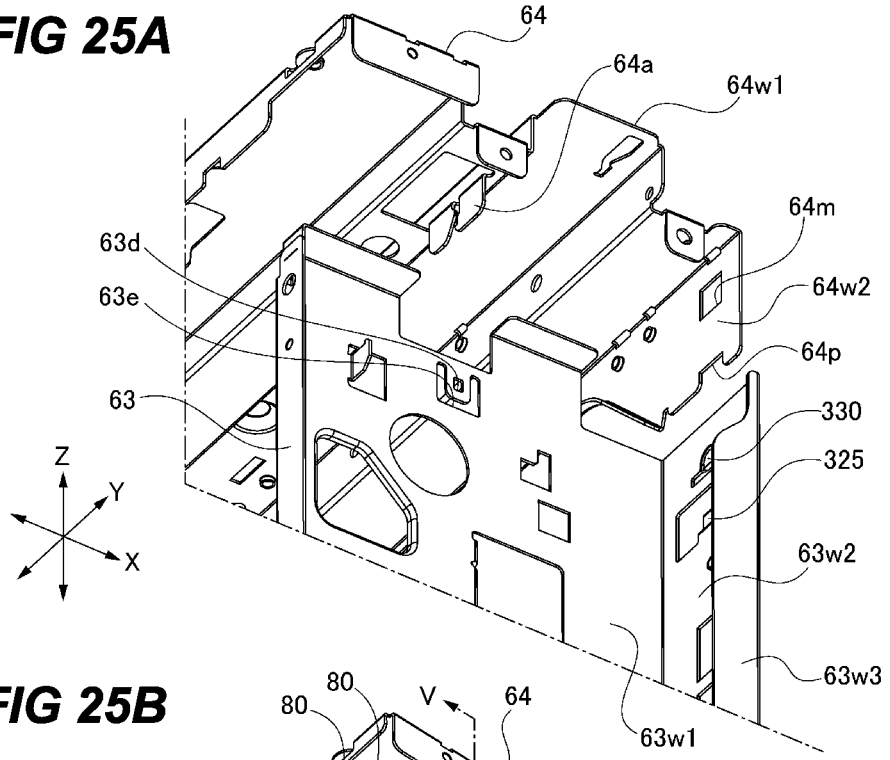
FIGS. 25A and 25B are a perspective view and an exploded perspective view of the right upper stay and the right support column.
Figure 25B:
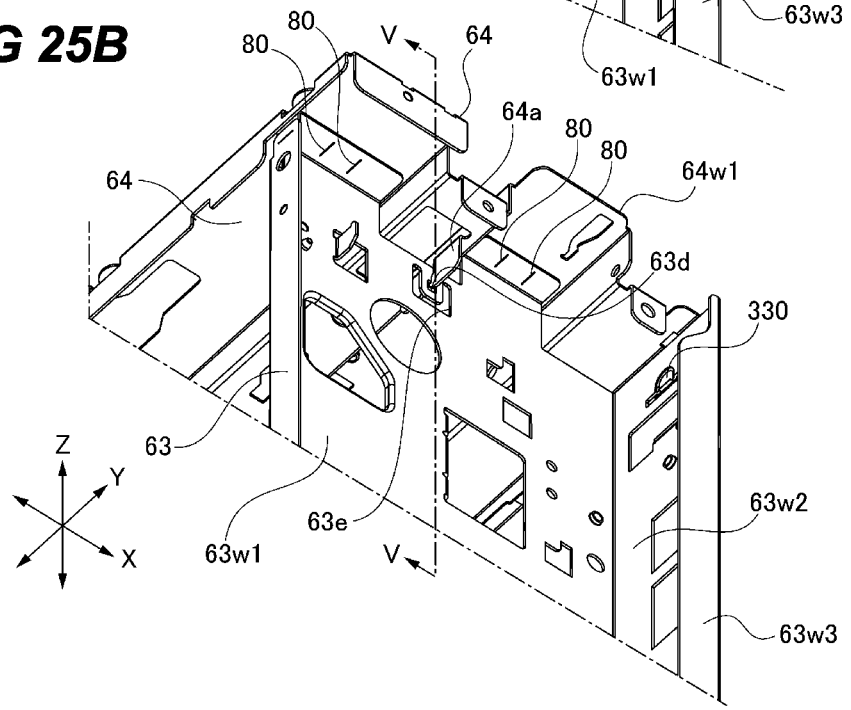

FIGS. 18A and 18B are perspective views of the right lower stay 61, the rear side plate 52, and the right support column 58. Here, FIG. 18A illustrates a state before the right lower stay 61 is assembled, and FIG. 18B illustrates a state where the right lower stay 61 is assembled. First, an assembly configuration of the right lower stay 61 and the rear side plate 52 will be described. As illustrated in FIGS. 25A and 25B, the flat surface portion 52*a* of the rear side plate 52 is provided with a bent portion 250 bent and raised toward the front surface side in the arrow Y direction. The bent portion 250 is bent and raised in a plate thickness direction of the flat surface portion 52*a* of the rear side plate 52, and is bent and raised in a direction opposite to the bent portion 52*w* with respect to the flat surface portion 52*a*. In addition, a through-hole 251 penetrating through the flat surface portion 52*a* in the plate thickness direction (arrow Y direction) of the flat surface portion 52*a* is formed around the bent portion 250, in the flat surface portion 52*a* of the rear side plate 52. As described above, the rear side plate 52 is formed of one metal plate, and the through-hole 251 is a hole formed when the bent portion 250 is processed.

The right lower stay 61 includes three flat surfaces and has a U-shaped cross section. The right lower stay 61 has a flat surface portion 61*w*1 extending substantially in parallel with the bent portion 52*w* of the rear side plate 52 and a flat surface portion 61*w*2 bent substantially vertically from the flat surface portion 61*w*1 in the arrow X direction at an upper portion of the flat surface portion 61*w*1. In addition, the right lower stay 61 has a flat surface portion 61*w*3 bent so as to face the flat surface portion 61*w*2 at a lower portion of the flat surface portion 61*w*1. The flat surface portion 61*w*1 of the right lower stay 61 is provided with a step-bent portion 61*a* inserted into and engaged with the bent portion 250 of the rear side plate 52. The step-bent portion 61*a* has a portion bent in the plate thickness direction (arrow X direction) of the flat surface portion 61*w*1 of the right lower stay 61 and a portion bent and extended from that portion in the insertion direction (arrow Y direction) into the rear side plate 52. The step-bent portion 61*a* is formed by forming a through-hole around the step-bent portion 61*a* at the time of being processed with respect to the flat surface portion 61*w*2 and bending the step-bent portion 61*a* with respect to the flat surface portion 61*w*2.

When the right lower stay 61 is assembled, the entirety of one end portion of the right lower stay 61 in the arrow Y direction is inserted into the through-hole 251 of the rear side plate 52, and the step-bent portion 61*a* of the right lower stay 61 is inserted into and engaged with the bent portion 250 of the rear side plate 52. As a result, the bent portion 250 of the rear side plate 52 is sandwiched from the plate thickness direction (arrow X direction) of the bent portion 250 by the step-bent portion 61*a* and the flat surface portion 61*w*1 in the right lower stay 61, such that a position of the right lower stay 61 with respect to the rear side plate 52 in the arrow X direction (plate thickness direction of the flat surface portion 61*w*1) is determined.

In addition, the flat surface portion 61*w*2, which is an upper surface of the right lower stay 61, and an inner wall of an upper side of the through-hole 251 of the rear side plate 52 face each other with a predetermined interval therebetween, and the flat surface portion 61*w*3, which is a lower surface of the right lower stay 61, and an inner wall of a lower side of the through-hole 251 of the rear side plate 52 are in contact with each other by a weight of the right lower stay 61. As a result, a position of the right lower stay 61 with respect to the rear side plate 52 in the vertical direction (arrow Z direction) is determined with a backlash corresponding to a predetermined interval.

Next, an assembly configuration of the right lower stay 61 and the right support column 58 will be described. As illustrated in FIGS. 25A and 25B, an insertion hole 58*a* into which a step-bent portion 61*b* of the right lower stay 61 is inserted is formed in the flat surface portion 58*w*2 of the right support column 58. Further, the right support column 58 has a flat surface portion (not illustrated) extending in the arrow Y direction behind the image forming apparatus A from the periphery of the insertion hole 58*a* in the flat surface portion 58*w*2. The flat surface portion (not illustrated) is provided with a projection portion (not illustrated) protruding in a plate thickness direction (arrow X direction) of the flat surface portion and having a substantially semi-circular shape. The projection portion (not illustrated) is formed by drawing, and is arranged at a position adjacent to the insertion hole 58*a* in an insertion direction (arrow Y direction) of the step-bent portion 61*b* into the insertion hole 58*a*.

In addition, the flat surface portion 61*w*1 of the right lower stay 61 is provided with the step-bent portion 61*b* inserted into and engaged with the insertion hole 58*a* of the right support column 58. The step-bent portion 61*b* has a portion bent in the plate thickness direction (arrow X direction) of the flat surface portion 61*w*1 and a portion bent and extended from that portion in the insertion direction (arrow Y direction) into the right support column 58.

In addition, a through-hole 61*c* penetrating the flat surface portion 61*w*1 in the plate thickness direction of the flat surface portion 61*w*1 is formed around the step-bent portion 61*b* in the flat surface portion 61*w*1 of the right lower stay 61. The through-hole 61*c* is arranged at a position adjacent to the step-bent portion 61*b* in the insertion direction of the right lower stay 61 into the right support column 58. As described above, the right lower stay 61 is formed of one metal plate, and the through-hole 61*c* is a hole formed when the step-bent portion 61*b* is processed.

When the right lower stay 61 is assembled, the step-bent portion 61*b* of the right lower stay 61 is inserted into and engaged with the insertion hole 58*a* of the right support column 58, and the projection portion (not illustrated) of the right support column 58 engages with the through-hole 61*c* of the right lower stay 61. As described above, the step-bent portion 61*b* engages with the insertion hole 58*a*, such that a position of the right lower stay 61 with respect to the right support column 58 in the arrow X direction, the arrow Y direction, and the arrow Z direction is determined. In addition, an upper surface of the step-bent portion 61*b* and an inner wall of an upper side of the insertion hole 58*a* face each other with a predetermined interval therebetween, and a lower surface of the step-bent portion 61*b* and an inner wall of a lower side of the insertion hole 58*a* face each other with a predetermined interval therebetween. As a result, a position of the right lower stay 61 with respect to the right support column 58 in a direction from the rear side toward the front side in the arrow Y direction is determined. With such a configuration, a position of the right lower stay 61 with respect to the right support column 58 in the arrow X direction, the arrow Y direction, and the vertical direction (arrow Z direction) is determined with a backlash corresponding to a predetermined interval.

In addition, in a state where the right lower stay 61 engages with the rear side plate 52 or the right support column 58, the projection portion (not illustrated) of the right support column 58 abuts on the inner wall of the through-hole 61*c*, such that movement of the right lower stay 61 with respect to the rear side plate 52 and the right support column 58 in a direction opposite to the insertion direction is restricted. The insertion direction of the right lower stay 61 into the rear side plate 52 and the right support column 58 is a direction orthogonal to a flat surface of the flat surface portion 52*a* of the rear side plate 52, and is a direction from the front side toward the rear side in the arrow Y direction. The opposite direction to the insertion direction of the right lower stay 61 into the rear side plate 52 and the right support column 58 is a direction orthogonal to a flat surface of the flat surface portion 52*a* of the rear side plate 52, and is a direction from the rear side toward the front side in the arrow Y direction.

Figure 19:
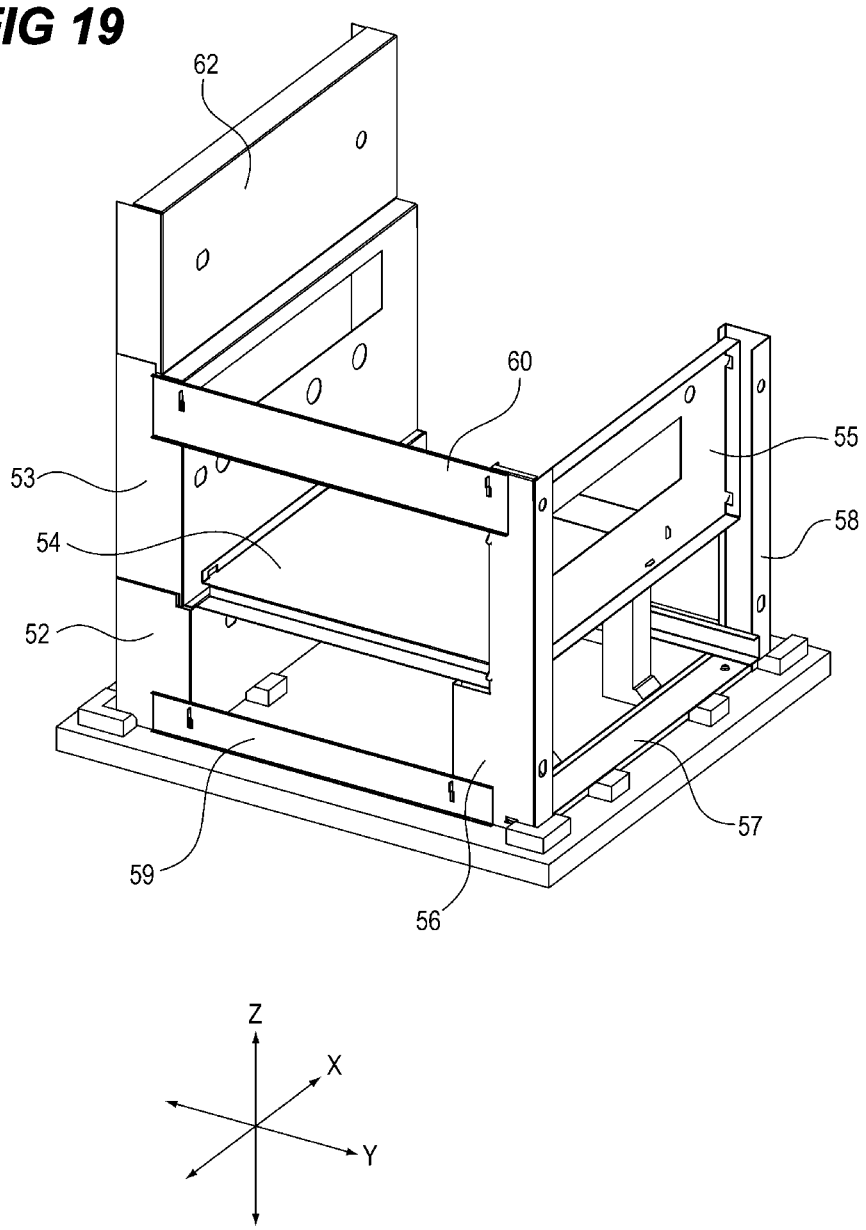
FIG. 19 is a perspective view when the rear side plate is assembled.

Next, as illustrated in FIG. 19, the rear side plate 62 is assembled. The rear side plate 62 is inserted and assembled into the rear side plate 53 from the arrow Z direction. An assembly configuration of the rear side plate 62 and the rear side plate 53 is similar to that of the rear side plate 52 and the rear side plate 53, and is an assembly configuration in which the rear side plate 62 and the rear side plate 53 are inserted into and engaged with each other.

Figure 20A:
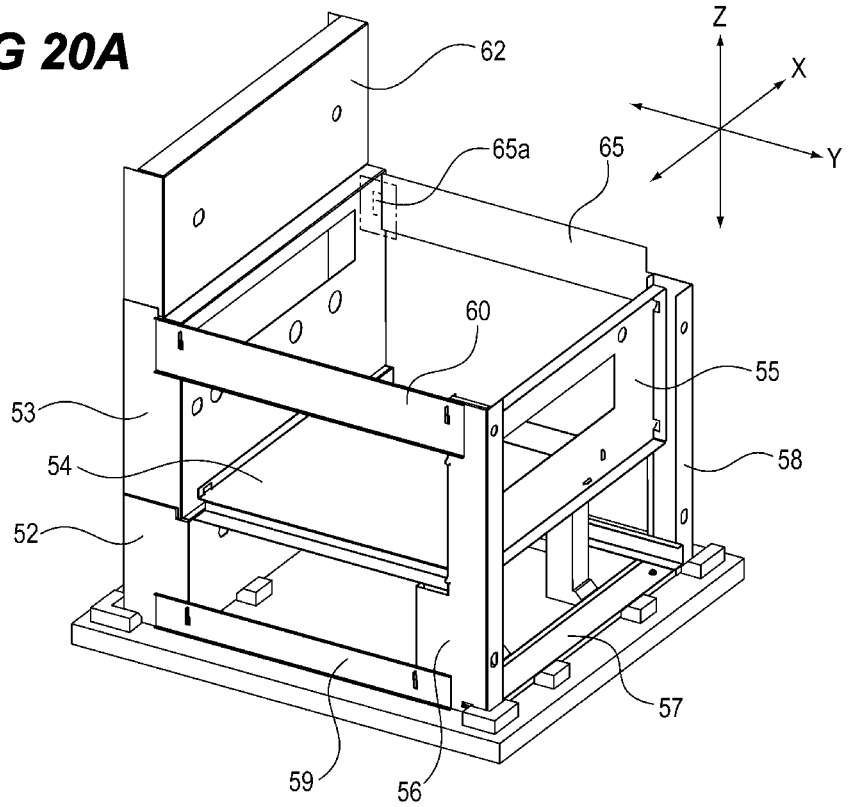
FIGS. 20A and 20B are perspective views when a right middle stay is assembled.
Figure 20B:
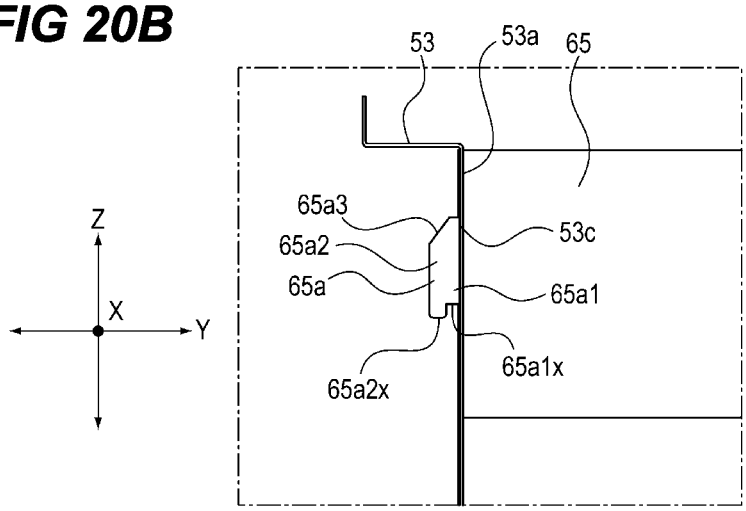

Next, as illustrated in FIGS. 20A and 20B, the right middle stay 65 is assembled. The right middle stay 65 is a plate-shaped member that is formed by one flat surface, and is a member that supports a fan cooling an end portion of the fixing portion 45 in a rotational axis direction. The right middle stay 65 is inserted and assembled into the rear side plate 53 and the right support column 58. An assembly configuration of the right middle stay 65 and the rear side plate 53 and an assembly configuration of the right middle stay 65 and the right support column 58 are similar to each other. Therefore, only the assembly configuration of the right middle stay 65 and the rear side plate 53 will be mainly described here.

A through-hole 53*c* penetrating the support portion 53*a* in the plate thickness direction (arrow Y direction) of the support portion 53*a* is formed in the support portion 53*a* of the rear side plate 53. Note that the rear side plate 53 is a member extending in the vertical direction. In addition, the right middle stay 65 is provided with a protrusion portion 65*a* protruding in an insertion direction (arrow Y direction) into the support portion 53*a* of the rear side plate 53 and inserted into the through-hole 53*c* of the rear side plate 53 from the arrow Y direction.

The protrusion portion 65*a* is provided at a base portion 65*a*1 that fits into the through-hole 53*c* and a tip side in the insertion direction from the base 65*a*1, and has a hook portion 65*a*2 in which the lower end portion 65*a*2*x* is located at a position vertically lower than the lower end portion 65*a*1*x* of the base portion 65*a*1. In addition, the protrusion portion 65*a* has an inclined portion 65*a*3 inclined so that a height decreases from an upper end portion of the base portion 65*a*1 to an upper end portion of the hook portion 65*a*2.

When the protrusion portion 65*a* is inserted into the through-hole 53*c*, the hook portion 65*a*2, which is a tip portion of the protrusion portion 65*a*, is first inserted, the base portion 65*a*1 is inserted, and the base portion 65*a*1 is then fitted into the through-hole 53*c*. A width of the base portion 65*a*1 of the protrusion portion 65*a* in the vertical direction and a width of the through-hole 53*c* in the vertical direction are substantially the same as each other. In addition, a plate thickness of the right middle stay 65 and a width of the through-hole 53*c* in the arrow X direction are substantially the same as each other. Therefore, the base portion 65*a*1 of the protrusion portion 65*a* is fitted into the through-hole 53*c*, such that a position of the right middle stay 65 with respect to the rear side plate 53 in the vertical direction (arrow Z direction) and a position of the right middle stay 65 with respect to the rear side plate in a direction (arrow X direction) orthogonal to the insertion direction and the vertical direction are determined.

Further, in the state in which the base portion 65*a*1 of the protrusion portion 65*a* is fitted into the through-hole 53*c*, a lower end portion 65*a*2*x* of the hooking portion 65*a*2 is located at a position facing the portion below the through-hole 53*c* in the support portion 53*a* of the rear side plate 53. In the present embodiment, the lower end portion 65*a*2*x* of the hook portion 65*a*2 protrudes 2 mm downward with respect to the lower end portion 65*a*1*x* of the base portion 65*a*1 and is provided so as to be spaced by 3 mm from the facing portion of the right middle stay facing the support portion 53*a* of the rear side plate 53. Here, the plate thickness of the support portion 53*a* of the rear side plate 53 is about 1 mm, and the length of the base portion 65*a*1 of the protrusion portion 65*a* in the arrow Y direction is longer than the plate thickness of the support portion 53*a* of the rear side plate 53. As a result, even though the rear side plate 53 and the right middle stay 65 are relatively inclined during assembly, the hook portion 65*a*2 is hooked on the support portion 53*a*, such that movement of the right middle stay 65 with respect to the support portion 53*a* of the rear side plate 53 in a direction opposite to the insertion direction is restricted. Therefore, the right middle stay 65 is prevented from being separated from the rear side plate 53, such that it is possible to assemble the right middle stay 65 and the rear side plate 53 to each other with high position accuracy. In addition, since the assembly configuration of the right middle stay 65 and the rear side plate 53 and the assembly configuration of the right middle stay 65 and the right support column 58 are the same as each other as described above, the right middle stay 65 is prevented from being separated from the right support column 58, such that it is possible to improve position accuracy of the right middle stay 65 and the right support column 58.

Figure 21:
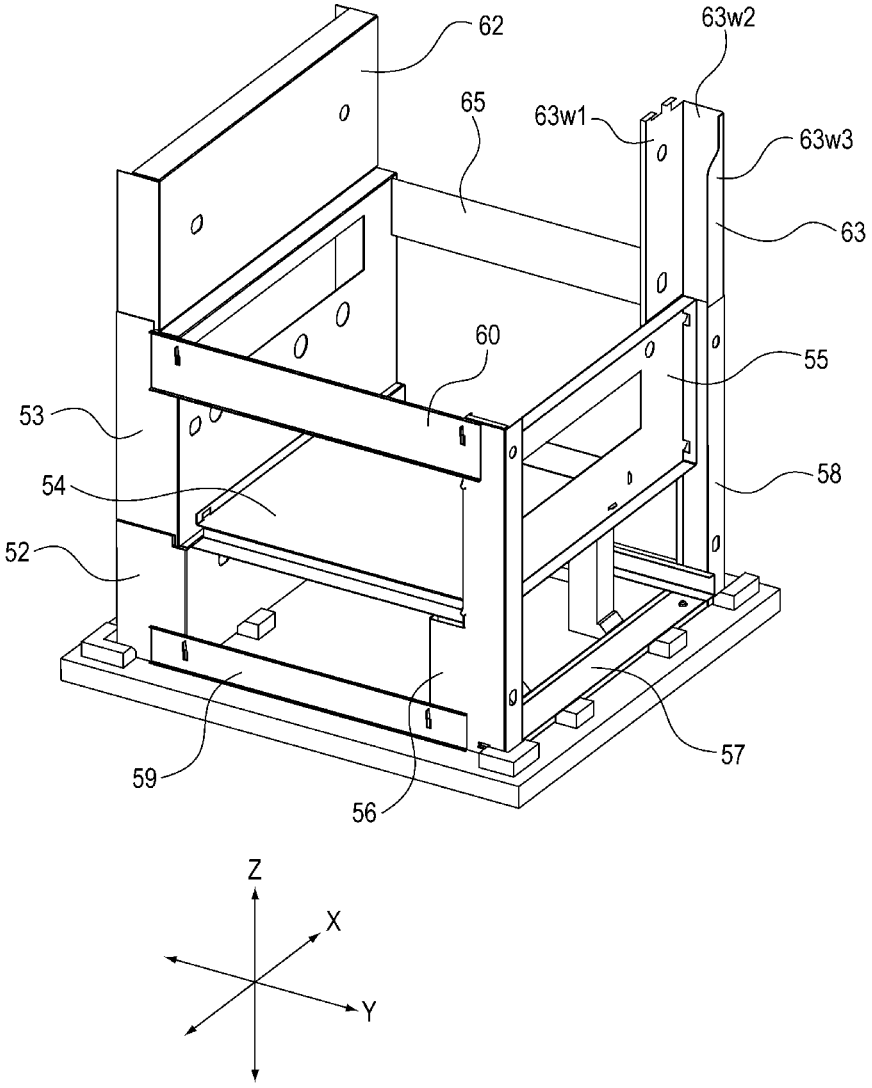
FIG. 21 is a perspective view when a right support column is assembled.

Next, as illustrated in FIG. 21, the right support column 63 is assembled. The right support column 63 faces the flat surface portion 63*w*1 vertically extending parallel to the flat surface portion 55*w*1 of the front side plate 55, the flat surface portion 63*w*2 bent substantially perpendicular to the arrow Y direction from the flat surface portion 63*w*1, and a flat surface portion 63*w*3 bent substantially vertically so as to face the flat surface portion 63*w*1 from the flat surface portion 63*w*2. The right support column 63 and the right support column 58 are inserted and assembled into each other.

Figure 22A:
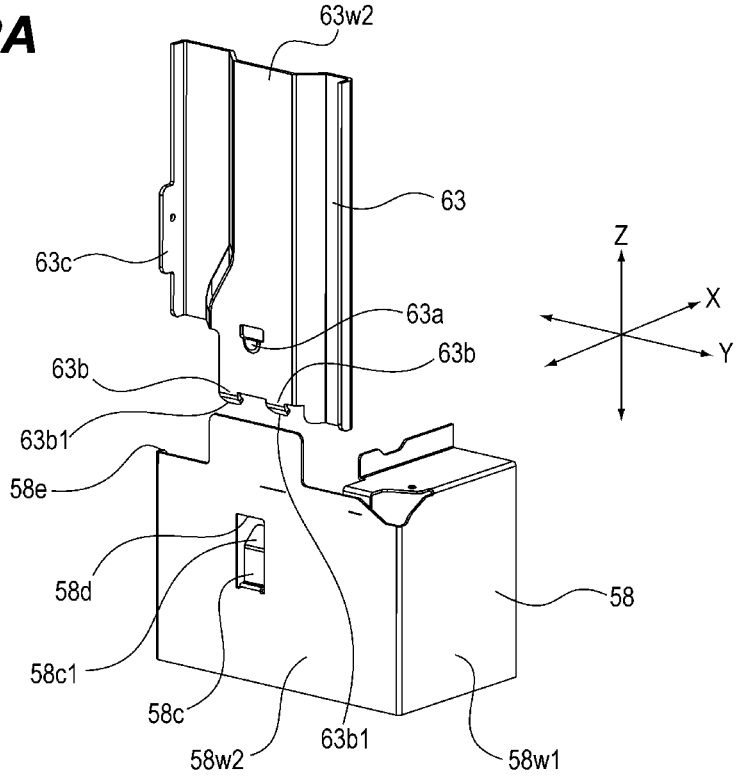
FIGS. 22A and 22B are enlarged perspective views of an engaging portion between the right support column and the right support column.
Figure 22B:
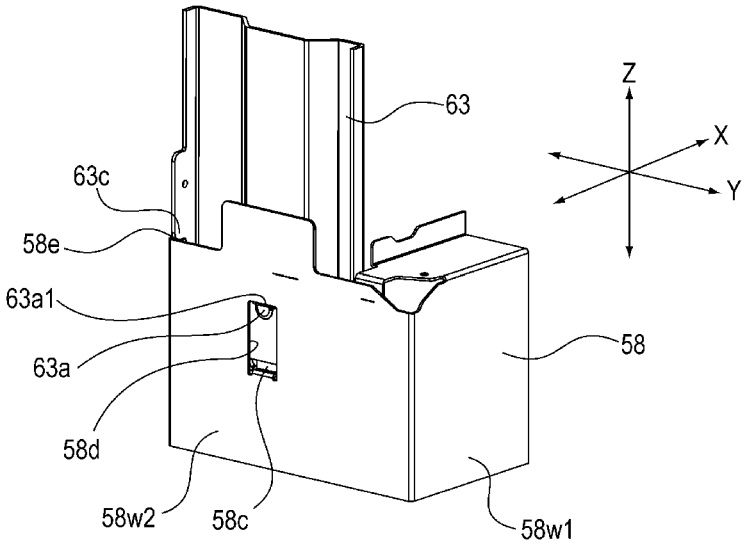

FIGS. 22A and 22B are enlarged perspective views of an engaging portion between the right support column 63 and the right support column 58. Here, FIG. 22A illustrates a state before the right support column 63 and the right support column 58 are assembled to each other, and FIG. 22B illustrates a state where the right support column 63 and the right support column 58 are assembled to each other.

As illustrated in FIGS. 22A and 22B, the flat surface portion 63*w*2 of the right support column 63 is provided with a projection portion 63*a* protruding in a plate thickness direction (arrow X direction) of the flat surface portion 63*w*2 and two protrusion portions 63*b* protruding in an insertion direction (arrow Z direction) into the right support column 58. Here, the protrusion portion 63*b* is provided below the projection portion 63*a* in the vertical direction (arrow Z direction). The projection portion 63*a* is formed by drawing, and the amount of protrusion from the surface of the flat surface portion 63*w*2 is about 0.3 mm to 2 mm. In addition, a tip portion of the protrusion portion 63*b* is an inclined portion 63*b*1 inclined in a direction away from the flat surface portion 63*w*2 with respect to the insertion direction of the right support column 63 into the right support column 58.

The flat surface portion 58*w*2 of the right support column 58 is provided with a step-bent portion 58*c* protruding in an insertion direction (arrow Z direction) of the right support column 58 into the right support column 63. In addition, a through-hole 58*d* penetrating the flat surface portion 58*w*2 in a plate thickness direction (arrow X direction) of the flat surface portion 58*w*2 is formed at a position adjacent to the step-bent portion 58*c* in the insertion direction of the right support column 58 with respect to the right support column 63. The step-bent portion 58*c* has a portion bent in the plate thickness direction of the flat surface portion 58*w*2 and a portion bent and extended from that portion in the insertion direction into the right support column 63. In addition, a tip portion of the step-bent portion 58*c* is an inclined portion 58*c*1 inclined in a direction away from the flat surface portion 58*w*2 with respect to the insertion direction of the right support column 58 into the right support column 63.

When the right support column 63 is assembled to the right support column 58, the inclined portion 58*c*1 of the step-bent portion 58*c* of the right support column 58 abuts on the flat surface portion 63*w*2 of the right support column 63, and the inclined portion 63*b*1 of the protrusion portion 63*b* of the right support column 63 abuts on the flat surface portion 58*w*2 of the right support column 58. As a result, movement of the right support column 63 and the right support column 58 in the arrow Z direction is guided, and the flat surface portion 63*w*2 and the flat surface portion 58*w*2 move in a predetermined positional relationship. In addition, a lower end portion of a stopper portion 63*c* of the right support column 63 butts a butting portion 58*e*, which is an upper end portion of the flat surface portion 58*w*2 of the right support column 58, such that movement of the right support column 63 with respect to the right support column 58 in the insertion direction (arrow Z direction) is restricted.

When the right support column 63 is assembled to the right support column 58, the step-bent portion 58*c* of the right support column 58 is inserted into the flat surface portion 63*w*2 of the right support column 63 and engages with a lower end portion of the flat surface portion 63*w*2. As a result, the flat surface portion 63*w*2 of the right support column 63 is sandwiched from the plate thickness direction (arrow X direction) of the flat surface portion 63*w*2 by the step-bent portion 58*c* and the flat surface portion 58*w*2 in the right support column 58, such that a position of the right support column 63 with respect to the right support column 58 in the arrow X direction is determined.

In addition, the projection portion 63*a* of the right support column 63 engages with the through-hole 58*d* formed in the right support column 58. As a result, an edge portion 63*a*1 of the projection portion 63*a* abuts on an inner wall of the through-hole 58*d*, such that movement of the right support column 58 with respect to the right support column 63 in a direction opposite to the insertion direction is restricted. Here, the through-hole 58*d* is arranged at a position adjacent to the step-bent portion 58*c* in the insertion direction of the right support column 58 into the right support column 63. Therefore, the projection portion 63*a* engaged with the through-hole 58*d* and the step-bent portion 58*c* are arranged at positions adjacent to each other in the insertion direction.

A configuration in which the edge portion 63*a*1 of the projection portion 63*a* abuts on the inner wall of the through-hole 58*d* formed when the step-bent portion 58*c* is processed has been described in the present embodiment, but a configuration in which the edge portion 63*a*1 of the projection portion 63*a* abuts on an inner wall of another through-hole different from the through-hole 58*d* may be adopted. As a result, the movement of the right support column 63 with respect to the right support column 58 in the direction opposite to the insertion direction is restricted.

In addition, in a direction (arrow Y direction) orthogonal to the plate thickness direction of the flat surface portion 63*w*2 and the insertion direction into the right support column 58, the two protrusion portions 63*b* of the right support column 63 engage with the step-bent portion 58*c* so as to sandwich the step-bent portion 58*c* of the right support column 58 therebetween. As a result, a position of the right support column 63 with respect to the right support column 58 in the orthogonal direction is determined.

As described above, the projection portion 63*a* restricting the movement of the right support column 63 with respect to the right support column 58 in the direction opposite to the insertion direction is provided in the vicinity of the step-bent portion 58*c* engaging the flat surface portion 63*w*2 of the right support column 63 and the flat surface portion 58*w*2 of the right support column 58 with each other. As a result, it is possible to prevent the right support column 63 from moving with respect to the right support column 58 in the direction opposite to the insertion direction, such that the right support column 63 and the right support column 58 are separated from each other, resulting in deterioration of position accuracy. Therefore, the right support column 63 and the right support column 58 that constitute the frame 31 can be assembled to each other with high position accuracy.

Figure 23:
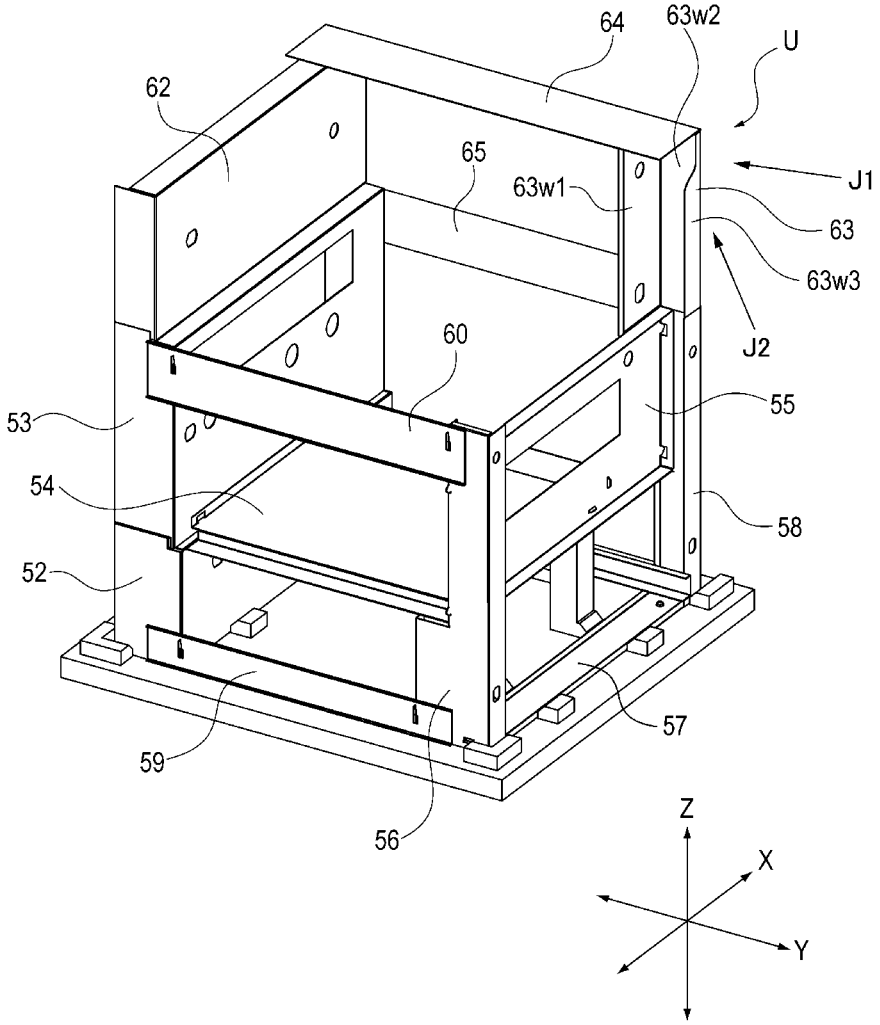
FIG. 23 is a perspective view when a right upper stay is assembled.

Next, as illustrated in FIG. 23, the right upper stay 64 (second metal plate, one metal plate) is inserted from the vertical direction (arrow Z direction) with respect to the rear side plate 62 and the right support column 63 (first metal plate, the other metal plate), and assembled. The right upper stay 64 has a flat surface portion 64*w*1 extending in the horizontal direction and a flat surface portion 64*w*2 in which one end portion of the flat surface portion 64*w*1 in the arrow X direction is bent substantially vertically downward in the vertical direction. The flat surface portion 64*w*1 is an example of an extension portion extending in the horizontal direction, and the flat surface portion 64*w*2 is an example of another extension portion extending in the vertical direction formed by bending a plurality of points (at least one place) with respect to the flat surface portion 64*w*1.

Figure 24A:
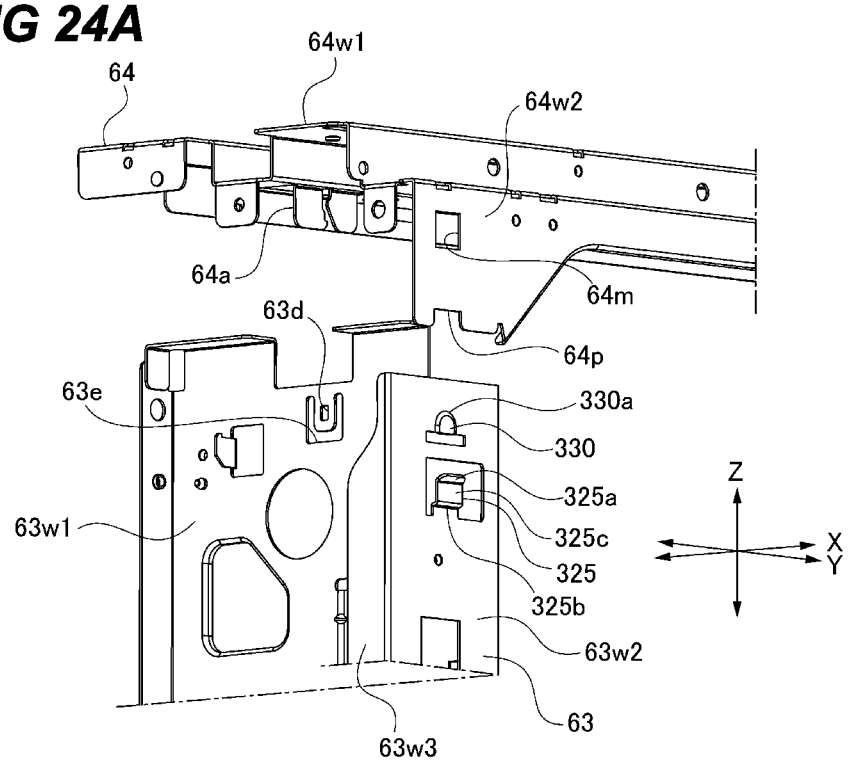
FIGS. 24A and 24B are a perspective view and an exploded perspective view of the right upper stay and the right support column.
Figure 24B:
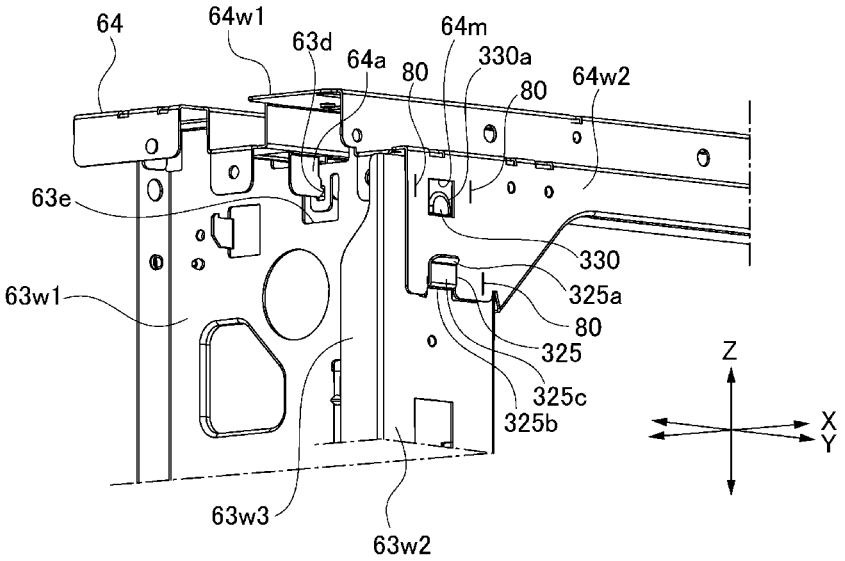

FIG. 24A is an exploded perspective view of a region U illustrated in FIG. 23 as viewed from an arrow J1 direction. FIG. 24B is a perspective view of a region U illustrated in FIG. 23 as viewed from an arrow J1 direction. As illustrated in FIGS. 24A and 24B, the flat surface portion 64*w*2 of the right upper stay 64 are provided with a through-hole 64*m* penetrating through the flat surface portion 64*w*2 in the plate thickness direction (arrow X direction) and a notch portion 64*p* in which a lower end portion of the flat surface portion 64*w*2 is cut out upward in the vertical direction.

Further, the flat surface portion 63*w*2 (another flat surface portion) of the right support column 63 is provided with a projection portion 330 protruding in the plate thickness direction (arrow X direction) of the flat surface portion 63*w*2 and a step-bent portion 325 (another engaging portion). The step-bent portion 325 has a first bent portion 325*b* bent in the plate thickness direction (arrow X direction) of the flat surface portion 63*w*2, and a second bent portion 325*c* that is bent substantially vertically upward from that portion and extends. Further, a tip portion of the step-bent portion 325 is an inclined portion 325*a* that is inclined in a direction away from the flat surface portion 63*w*2 of the right support column 63 with respect to the insertion direction (arrow Z direction) into the right support column 63 into the right upper stay 64

When the right upper stay 64 is assembled, the step-bent portion 325 of the right support column 63 is inserted into and engages with the notch portion 64*p* of the right upper stay 64. At this time, the inclined portion 325*a* of the step-bent portion 325 of the right support column 63 abuts on the edge portion of the notch portion 64*p* of the right upper stay 64, so the movement of the right upper stay 64 in the arrow Z direction is guided. In addition, when the right upper stay 64 is assembled to the right support column 63, the flat surface portion 64*w*2 of the right upper stay 64 is sandwiched by the step-bent portion 325 and the flat surface portion 63*w*2 of the right support column 63 from the arrow X direction, and the position of the right upper stay 64 with respect to the right support column 63 in the arrow X direction is determined. Further, the notch portion 64*p* abuts on the portion of the step-bent portion 325 bent in the plate thickness direction of the flat surface portion 63*w*2, so the position of the right upper stay 64 with respect to the right support column 63 in the Z direction is determined.

In addition, when the right upper stay 64 is assembled to the right support column 63, the projection portion 330 of the right support column 63 engages with the through-hole 64*m* (engagement hole) of the right upper stay 64. In such an engaged state between the projection portion 330 and the through-hole 64*m*, when the right upper stay 64 is viewed from the right side of the image forming apparatus A in the arrow Y direction, the projection portion 330 is located inside the through-hole 64*m*. As a result, when some force is applied during work and the right upper stay 64 moves upward in the vertical direction and is separated from the right support column 63, the edge portion 330*a* of the projection portion 330 abuts on the inner wall of the through-hole 64*m*, and the movement of the right upper stay 64 in the direction opposite to the insertion direction with respect to the right support column 63, that is, the movement of the right upper stay 64 upward in the vertical direction is restricted.

Further, the rear side plate 62 is also provided with the projection portion (not illustrated) and the step-bent portion (not illustrated) similar to the projection portion 330 and the step-bent portion 325 of the right support column 63. Further, the through-hole (not illustrated) and the notch portion (not illustrated) similar to the through-hole 64*m* and the notch portion 64*p* are also provided at the position of the right upper stay 64 on the flat surface portion 64*w*2 facing the rear side plate 62. When the right upper stay 64 is assembled, the step-bent portion (not illustrated) of the rear side plate 62 is inserted into the notch portion (not illustrated) of the right upper stay 64 and engages with the notch portion, so the positions in the arrow X direction and the arrow Z direction with respect to the rear side plate 62 of the right upper stay 64 are determined.

In addition, when the right upper stay 64 is assembled to the rear side plate 62, the projection portion (not illustrated) of the rear side plate 62 engages with the through-hole (not illustrated) of the right upper stay 64. When the right upper stay 64 moves upward in the vertical direction and is separated from the rear side plate 62, the edge portion of the projection portion (not illustrated) of the rear side plate 62 abuts on the inner wall of the through-hole (not illustrated) of the right upper stay 64. As a result, the movement in the direction opposite to the insertion direction with respect to the rear side plate 62 of the right upper stay 64, that is, the movement in the vertical direction upward is restricted.

FIG. 25A is an exploded perspective view of a region U illustrated in FIG. 23 as viewed from an arrow J2 direction. FIG. 25B is a perspective view of the region U illustrated in FIG. 23 as viewed from an arrow J2 direction. As illustrated in FIGS. 25A and 25B, the flat surface portion 64*w*1 of the right upper stay 64 is provided with the hook portion 64*a* (engaging portion) formed by bending from the flat surface portion 64*w*1 downward in the vertical direction substantially perpendicular (89° to 91°) to the flat surface portion 64*w*1. The hook portion 64*a* engages with the flat surface portion 63*w*1 of the right support column 63 from the vertical direction. Further, the hook portion 64*a* is in a state of engaging with the right support column 63 by being inserted into the hole portion 63*d* formed in the flat surface portion 63*w*1 of the right support column 63. The hole portion 63*d* is a through-hole penetrating in the arrow Y direction, which is the plate thickness direction of the flat surface portion 63*w*1 and the direction intersecting the vertical direction.

Figure 26:
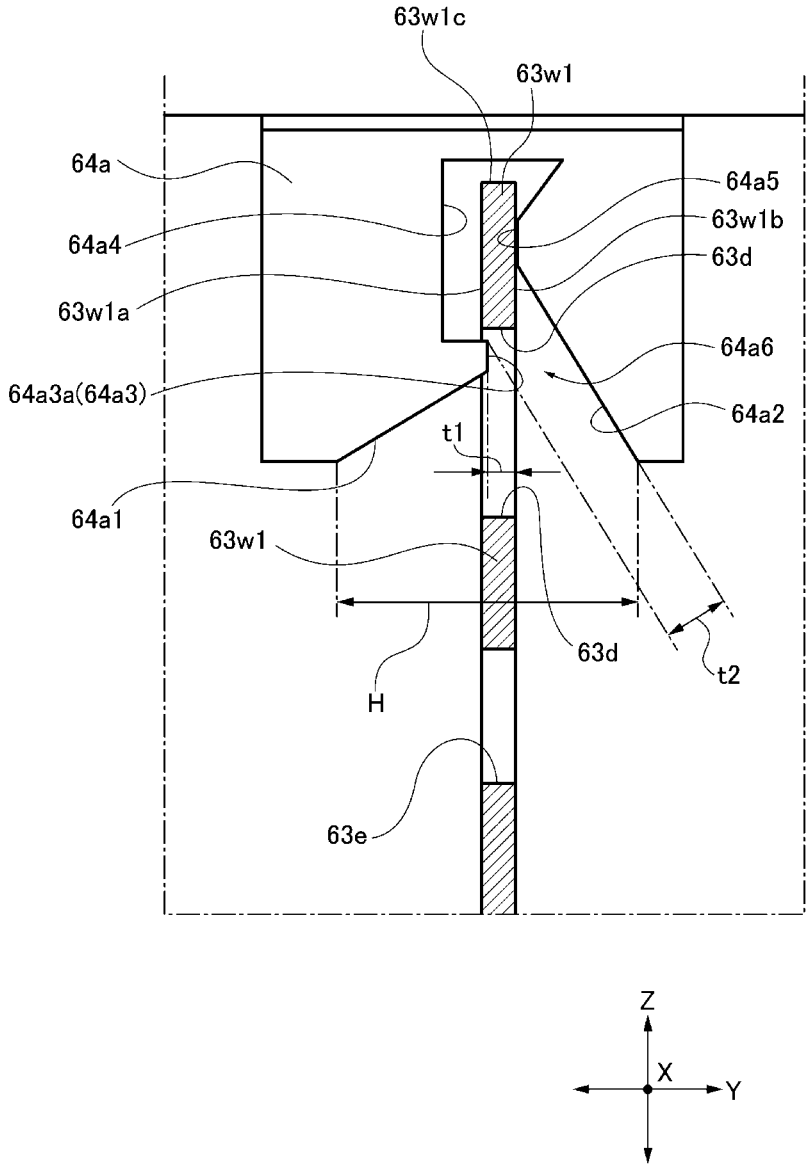
FIG. 26 is a cross-sectional view of a flat surface portion of the right support column and a hook portion of the right upper stay.

FIG. 26 is a cross-sectional view of the flat surface portion 63*w*1 of the right support column 63 and the hook portion 64*a* of the right upper stay 64 cut along the V-V cross section illustrated in FIG. 25B. As illustrated in FIG. 26, the hook portion 64*a* has an insertion portion 64*a*3 inserted from one side surface 63*w*1*a* (first surface) of the flat surface portion 63*w*1 in the arrow Y direction respect to the hole portion 63*d*. Further, the hook portion 64*a* has a facing portion 64*a*4 (first surface) facing the one side surface 63*w*1*a* (first surface) of the flat surface portion 63*w*1 of the right support column 63 in the arrow Y direction and a facing portion 64*a*5 (second facing portion) facing the other side surface 63*w*1*b* (second surface) in a state where the insertion portion 64*a*3 is inserted into the hole portion 63*d*. The surface 63*w*1*a* of the flat surface portion 63*w*1 of the right support column 63 is the surface on the side where the insertion portion 64*a*3 of the hook portion 64*a* is inserted in the direction of the arrow Y. Further, the hook portion 64*a* has an inclined portion 64*a*1 which is arranged below the insertion portion 64*a*3 in the vertical direction, provided continuously from the insertion portion 64*a*3, and inclined in a direction away from the hole portion 63*d* in the vertical direction. Further, the hook portion 64*a* has an inclined portion 64*a*2 (another inclined portion) which is arranged below the facing portion 64*a*5 adjacent to the facing portion 64*a*5 in the vertical direction, and is inclined in a direction away from the hole portion 63*d* in the vertical direction.

When the insertion portion 64*a*3 of the hook portion 64*a* is inserted into the hole portion 63*d* and the hook portion 64*a* engages with the right support column 63, the flat surface portion 63*w*1 of the right support column 63 is sandwiched by the facing portion 64*a*4 and the facing portion 64*a*5 of the hook portion 64*a* in the arrow Y direction. By sandwiching the flat surface portion 63*w*1 from the arrow Y direction by the hook portion 64*a* in this way, the position of the right upper stay 64 in the arrow Y direction with respect to the right support column 63 is determined. In the present embodiment, the facing portion 64*a*5 of the hook portion 64*a* is in contact with the surface 63*w*1*b* of the flat surface portion 63*w*1 of the right support column 63, but the facing portion 64*a*4 is not in contact with the surface 63*w*1*a*, and there is a gap between the facing portion 64*a*4 and the surface 63*w*1*a*. Therefore, by engaging the hook portion 64*a* with the right support column 63, the position of the right upper stay 64 in the arrow Y direction with respect to the right support column 63 is determined in the state where the right upper stay 64 has a backlash corresponding to this gap. Note that the facing portion 64*a*5 of the hook portion 64*a* may be non-contact as long as it faces the surface 63*w*1*b* of the flat surface portion 63*w*1 of the right support column 63 in the arrow Y direction.

Here, a distance t1 in the arrow Y direction between a tip portion 64*a*3*a* of the insertion portion 64*a*3 of the hook portion 64*a* and the facing portion 64*a*5 is set smaller than the plate thickness of the flat surface portion 63*w*1 of the right support column 63. Specifically, in the present embodiment, since the right support column 63 is a galvanized steel plate having a plate thickness of 0.8 mm, the distance t1 is set to 0.7 mm, which is smaller than the plate thickness of the flat surface portion 63*w*1 of the right support column 63. With such a configuration, even when the insertion portion 64*a*3 of the hook portion 64*a* is inserted into the hole portion 63*d* and an upward force is applied to the right upper stay 64 in the vertical direction, the insertion portion 64*a*3 interferes with the upper inner wall of the hole portion 63*d*, and the upward movement of the right upper stay 64 is restricted. Therefore, it is suppressed that the right upper stay 64 is separated from the right support column 63, and the right upper stay 64 is suppressed from being separated.

That is, since the right upper stay 64 is arranged at the uppermost position of the frame 31, in the temporarily assembled state before the metal plates constituting the frame 31 are fixed to each other, when there is no configuration that restricts the vertical movement upward, the right upper stay 64 is easily separated upward due to vibration or impact. The right upper stay 64 defines the distance in the arrow Y direction between the rear side plate 62 and the right support column 63, and when the right upper stay 64 is separated, the positional relationship between the two changes and the overall position accuracy of the frame 31 deteriorates.

On the other hand, in the present embodiment, the hook portion 64*a* of the right upper stay 64 restricts the movement of the right upper stay 64 in the direction opposite to the insertion direction with respect to the right support column 63. With such a configuration, it is possible to suppress the right upper stay 64 from being separated from the right support column 63, and to suppress the deterioration of the positional accuracy between the right upper stay 64 and the right support column 63. Further, since the distance between the rear side plate 62 and the right support column 63 in the arrow Y direction is properly maintained, it is possible to suppress the deterioration of the overall position accuracy of the frame 31. In the present embodiment, since the projection portion 330 of the right support column 63 engages with the through-hole 64*m* of the right upper stay 64 to restrict the vertical movement of the right upper stay 64 with respect to the right support column 63, the effect of suppressing the right upper stay 64 from separating from the right support column 63 is further improved.

Further, when the hook portion 64*a* is moved downward in the vertical direction in order to move the insertion portion 64*a*3 of the hook portion 64*a* to the position of the hole portion 63*d*, the inclined portion 64*a*1 or the inclined portion 64*a*2 of the hook portion 64*a* abuts on the upper end portion 63*w*1*c* of the flat surface portion 63*w*1 of the right support column 63. As a result, the movement of the hook portion 64*a* is guided so that the flat surface portion 63*w*1 passes through the gap 64*a*6 between the insertion portion 64*a*3 and the inclined portion 64*a*2 of the hook portion 64*a*. That is, when the right upper stay 64 is arranged so that the upper end portion 63*w*1*c* of the flat surface portion 63*w*1 is located inside the range H illustrated in FIG. 26 in the arrow Y direction, the inclined portions 64*a*1 and 64*a*2 guide the downward movement of the right upper stay 64 in the vertical direction. Therefore, since the hook portion 64*a* has the inclined portions 64*a*1 and 64*a*2, the hook portion 64*a* can easily engage with the right support column 63. Further, by setting the minimum distance t2 of the gap 64*a*6 to be equal to or larger than the plate thickness of the flat surface portion 63*w*1 of the right support column 63, the flat surface portion 63*w*1 can easily pass through the gap 64*a*6, and the hook portion 64*a* can easily engage with the right support column 63. Therefore, in the present embodiment, the minimum distance t2 is set to 2.0 mm, and the minimum distance t2 is made longer than 0.8 mm which is the plate thickness of the flat surface portion 63*w*1.

Figure 27A:
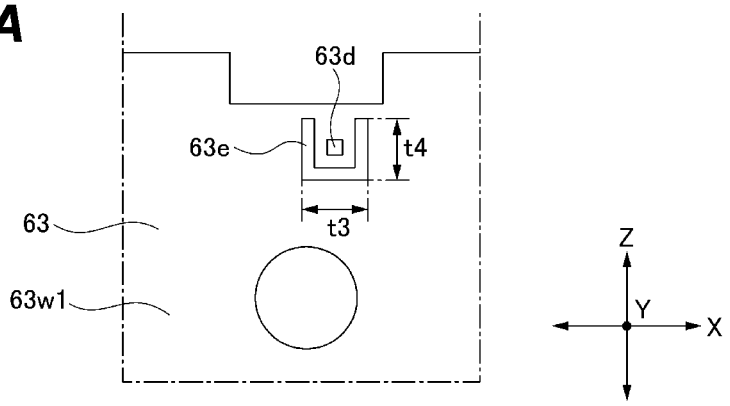
FIGS. 27A to 27C are diagrams illustrating a configuration around a hole portion in the flat surface portion of the right support column.

Further, as described above, the distance t1 between the tip portion 64*a*3*a* of the insertion portion 64*a*3 and the facing portion 64*a*5 is set to be smaller than the plate thickness of the flat surface portion 63*w*1 of the right support column 63. Therefore, when the hook portion 64*a* moves downward in the vertical direction in order to move the insertion portion 64*a*3 of the hook portion 64*a* to the position of the hole portion 63*d*, the hook portion 64*a* moves while elastically deforming the circumference of the hole portion 63*d* in the flat surface portion 63*w*1 in the plate thickness direction of the flat surface portion 63*w*1. That is, when the hook portion 64*a* moves downward in the vertical direction, the flat surface portion 63*w*1 is sandwiched between the tip portion 64*a*3*a* of the insertion portion 64*a*3 and the facing portion 64*a*5 from the arrow Y direction, and the flat surface portion 63*w*1 is elastically deformed. Therefore, in order to facilitate the elastic deformation around the hole portion 63*d* in the flat surface portion 63*w*1 and improve the assemblability, a substantially U-shaped slit 63*e* is provided around the hole portion 63*d* in the flat surface portion 63*w*1 of the right support column 63. In the present embodiment, the right support column 63 is a galvanized steel plate having a plate thickness of 0.8 mm. Therefore, as illustrated in FIG. 27A, by setting the dimensions of the slit 63*e* to t3=8 mm and t4=12 mm, the above-described deformation around the hole portion 63*d* of the flat surface portion 63*w*1 can be performed in the elastic region.

Figure 27B:
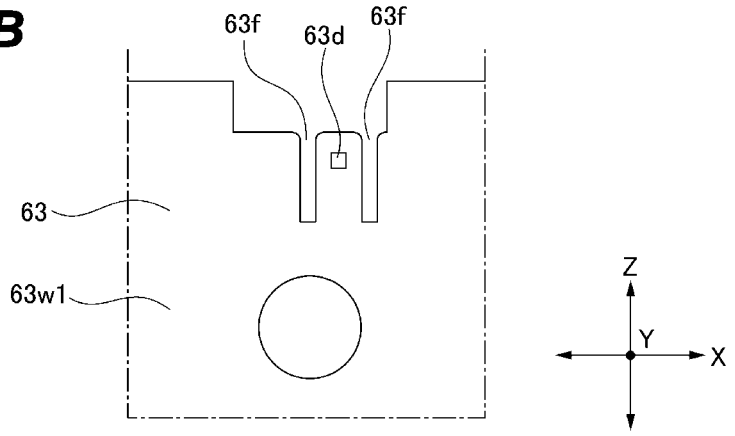
Figure 27C:
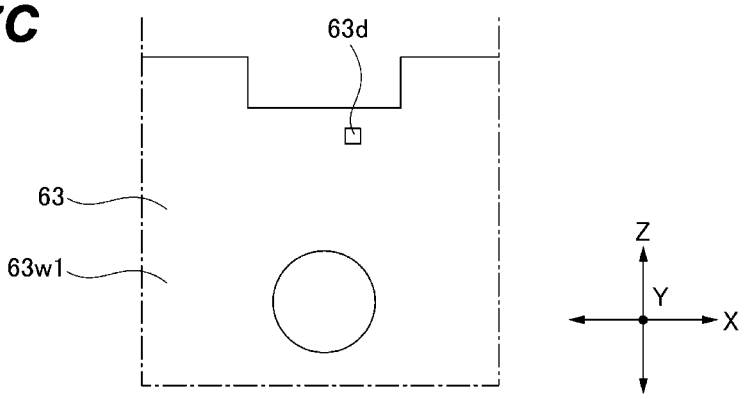

Note that the shape of the right support column 63 around the hole portion 63*d* of the flat surface portion 63*w*1 is not limited to the shape of the present embodiment. That is, for example, as illustrated in FIG. 27B, a slit 63*f* having another shape is provided in the flat surface portion 63*w*1, the upper portion of the hole portion 63*d* in the flat surface portion 63*w*1 may be a free end, and the flat surface portion 63*w*1 may be greatly elastically deformed when the right upper stay 64 is assembled to the right support column 63. Further, as illustrated in FIG. 27C, even when a shape that is easily elastically deformed is not provided around the hole portion 63*d* of the flat surface portion 63*w*1, when the insertion portion 64*a*3 can be configured to engage with the hole portion 63*d*, it is possible to obtain the effect of suppressing the right upper stay 64 from separating from the right support column 63.

Further, in the present embodiment, the configuration in which the hook portion 64*a* is provided on the right upper stay 64 and the hole portion 63*d* with which the hook portion 64*a* is engaged is provided on the right support column 63 has been described, but the present invention is not limited thereto. That is, when a similar hook portion is provided on the metal plate on either side of the right support column 63 and the right upper stay 64, and a hole portion with which the hook portion engages is provided on the metal plate on the other side, the same effect as described above can be obtained. In addition, when a similar hook portion is provided on the metal plate on either side of the rear side plate 62 and the right upper stay 64, and a hole portion with which the hook portion engages is provided on the metal plate on the other side, the same effect as described above can be obtained. When the hook portion is provided on the right support column 63 or the rear side plate 62, the inclined portion 64*a*1 is arranged on the vertical upper portion of the insertion portion 64*a*3, and the inclined portion 64*a*2 is arranged on the vertical upper portion of the facing portion 64*a*5.

As described above, the respective metal plates constituting the frame 31 are assembled. The frame 31 assembled in the assembling process as described above is configured to be able to stand for oneself. Therefore, the frame 31 can be detached from the stand 33 by grasping the rear side plate 52, the left support column 56, the right support column 58, and the like, of the frame 31 and lifting the frame 31.

<Frame Fixing Process>

Next, a process of fixing the frame 31 assembled in the assembling process described above will be described.

Figure 28:
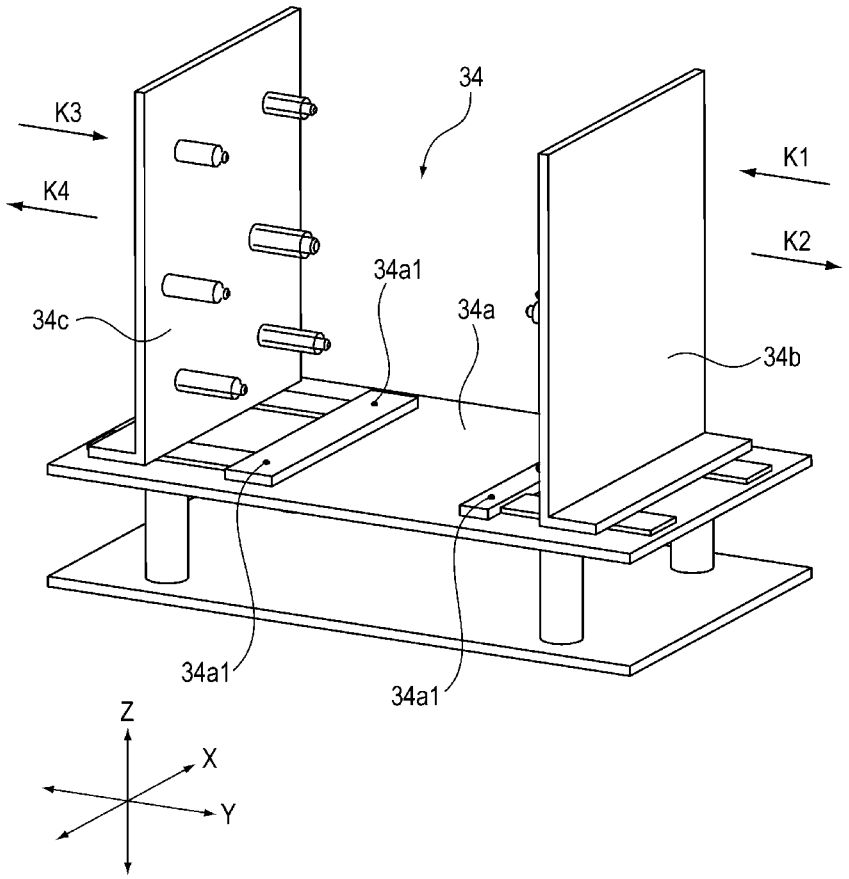
FIG. 28 is a perspective view of a jig used for fixing the frame.

FIG. 28 is a perspective view of a jig 34 used for fixing of the frame 31. As illustrated in FIG. 28, the jig 34 has a base 34*a*, a front side support portion 34*b*, and a rear side support portion 34*c*. The base 34*a* is provided with positioning pins 34*a*1. In addition, the front side support portion 34*b* and the rear side support portion 34*c* are configured to be slidable with respect to the base 34*a*. The front side support portion 34*b* slides in the directions of arrows K1 and K2, and the rear side support portion 34*c* slides in the directions of arrows K3 and K4.

Figure 29:
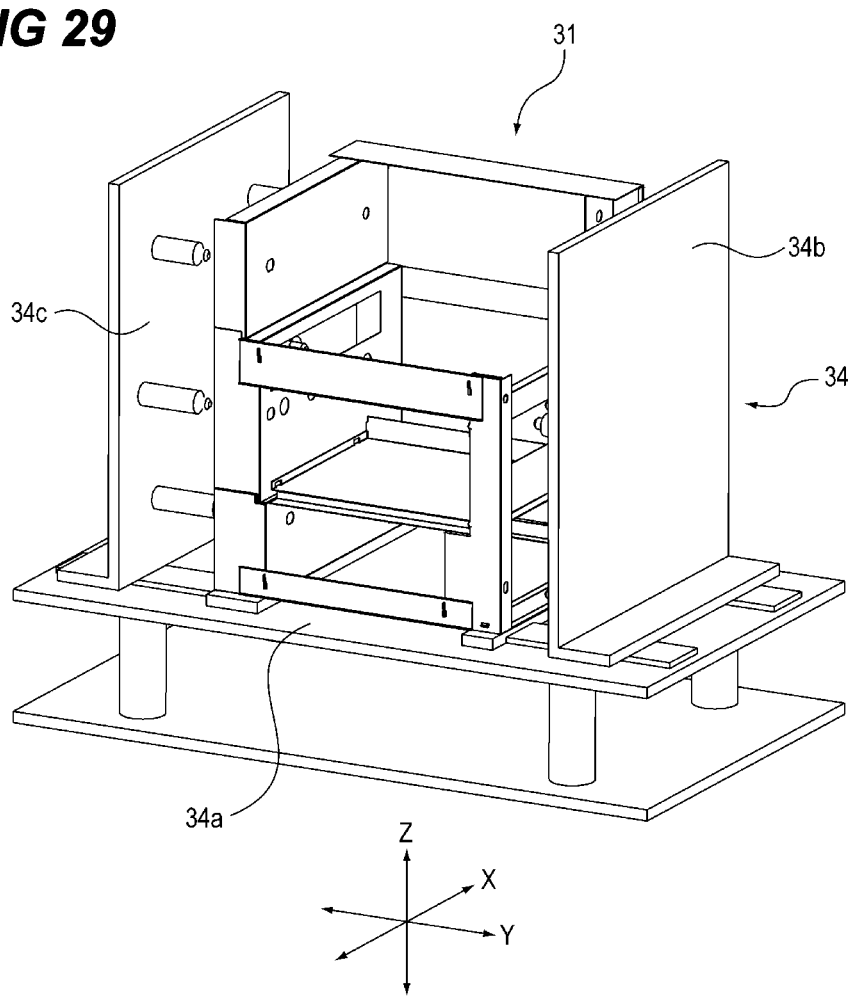
FIG. 29 is a perspective view of the frame and the jig.

FIG. 29 is a perspective view of the frame 31 assembled in the assembling process described above and the jig 34. As illustrated in FIG. 29, the frame 31 is detached from the stand 33 and placed on the base 34*a* of the jig 34 after the assembling process. At this time, the positioning pins 34*a*1 of the base 34*a* are inserted into the positioning holes 51*a* of the rear bottom plate 51 of the frame 31 or the positioning holes 57*b* of the front lower stay 57, such that a position of the frame 31 with respect to the base 34*a* is determined.

Figure 30:
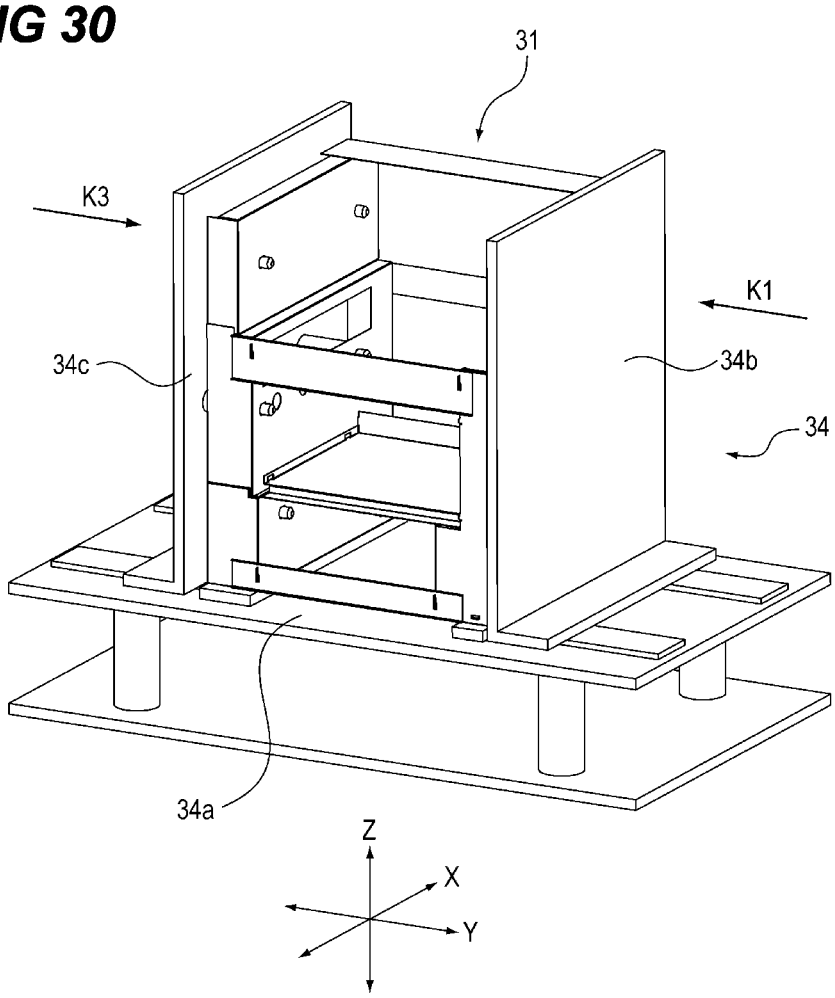
FIG. 30 is a perspective view of the frame and the jig.

As illustrated in FIG. 30, when fixing the frame 31, an operator who performs a fixing process slides the front side support portion 34*b* in the arrow K1 direction and slides the rear side support portion 34*c* in the arrow K3 direction. In addition, the frame 31 is pressed from a direction orthogonal to slide directions of the front side support portion 34*b* and the rear side support portion 34*c* and the vertical direction by a pressing device (not illustrated). As a result, the metal plates constituting the frame 31 are pressed against each other, such that unnecessary gaps between the metal plates are eliminated, and positioning is completed.

Then, the respective metal plates constituting the frame 31 are fixed to each other by fiber laser welding by the operator. At this time, the welding of the right upper stay 64 and the right support column 63 is performed at a welded portion 80 illustrated in FIGS. 24B and 25B. When the fixing of the frame 31 is completed, the operator slides the front side support portions 34*b* in the arrow K2 direction, slides the rear side support portions 34*c* in the arrow K4 direction, and detaches the frame 31 from the jig 34. As a result, the frame 31 is completed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-154950, filed Sep. 15, 2020, which is hereby incorporated by reference herein in its entirety.

What is claimed is:

1. A metal frame of an image forming apparatus, comprising:

a first support member configured to support one end of an image forming unit that forms an image on a sheet, the first support member including a first metal plate;

a second support member which is spaced apart from the first support member and configured to support the other end of the image forming unit; and a third support member configured to connect the first support member and the second support member, the third support member including a second metal plate that engages with the first metal plate, wherein either the first metal plate or the second metal plate includes a through-hole formed in a surface portion extending in the vertical direction, the other of the first metal plate and the second metal plate includes an insertion portion to be inserted into the through-hole, a first facing portion configured to face a first surface, which is one surface of the surface portion in a plate thickness direction of the surface portion, and is at a position above the insertion portion in the vertical direction and is continuously provided from the insertion portion, and a second facing portion configured to face a second surface, which is a surface opposite to the first surface in the plate thickness direction of the surface portion, and wherein in the plate thickness direction of the surface portion, a distance between a tip portion of the insertion portion and the second facing portion is smaller than a plate thickness of the surface portion of the other metal plate.

2. The metal frame of an image forming apparatus according to claim 1, wherein the second facing portion is in contact with the second surface of the surface portion.

3. The metal frame of an image forming apparatus according to claim 1, wherein the other metal plate includes an inclined portion which is located below the insertion portion in the vertical direction, is continuously provided from the insertion portion, and is inclined in a direction away from the through-hole with respect to the vertical direction.

4. The metal frame of an image forming apparatus according to claim 1, wherein the other metal plate includes another inclined portion which is located below the second facing portion in the vertical direction, is continuously provided from the second facing portion, and is inclined in a direction away from the through-hole with respect to the vertical direction.

5. The metal frame of an image forming apparatus according to claim 1, wherein the second metal plate includes the insertion portion, the first facing portion, the second facing portion, and an extension portion extending horizontally, and wherein the insertion portion, the first facing portion, and the second facing portion are formed by being bent downward in the vertical direction from the extension portion.

6. The metal frame of an image forming apparatus according to claim 5, wherein the second metal plate includes another extension portion that is bent from the extension portion and extends downward in the vertical direction, wherein the first metal plate includes another surface portion which is bent from the surface portion and correspond to the another extension portion, a first bent portion which is provided on the another surface portion and bent in a plate thickness direction of the another surface portion, and a second bent portion which is bent so as to extend vertically from the first bent portion toward the second metal plate, and wherein the another extension portion is sandwiched between the another surface portion and the second bent portion in the plate thickness direction of the another extension portion.

7. The metal frame of an image forming apparatus according to claim 6, wherein the second metal plate includes an engagement hole formed in the another extension portion, and the first metal plate includes a projection portion that protrudes in the plate thickness direction of the another surface portion, and wherein the projection portion is located inside the engagement hole.

8. The metal frame of an image forming apparatus according to claim 4, wherein a minimum distance between the insertion portion and the other inclined portion is equal to or greater than a thickness of the one metal plate.

9. The metal frame of an image forming apparatus according to claim 1, wherein the surface portion is formed with a slit around the through-hole so that a part of the surface portion is elastically deformed when the first metal plate and the second metal plate engage with each other.

10. The metal frame of an image forming apparatus according to claim 1, wherein the first support member includes a first side plate which supports the image forming unit, a first support column which supports one end side in a direction orthogonal to a vertical direction and a plate thickness direction of the surface portion of the first side plate in the first side plate, and a second support column which supports the other end side in a direction orthogonal to the vertical direction and the plate thickness direction of the first side plate in the first side plate, the second support member includes a second side plate that supports the image forming unit together with the first side plate, and the first metal plate is the first support column.

11. An image forming apparatus, comprising:

an image forming unit configured to form an image on a sheet;

the metal frame of the image forming apparatus according to claim 1, the metal frame supporting the image forming unit; and an outer cover configured to cover the metal frame.

* * * * *